US010030467B2

(12) United States Patent
Al-Gouhi

(10) Patent No.: US 10,030,467 B2
(45) Date of Patent: Jul. 24, 2018

(54) METHOD AND APPARATUS FOR SEALING AN UNDESIRABLE FORMATION ZONE IN THE WALL OF A WELLBORE

(71) Applicant: Saudi Arabian Oil Company, Dhahran (SA)

(72) Inventor: Waleed Abdullah Al-Gouhi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 281 days.

(21) Appl. No.: 14/663,812

(22) Filed: Mar. 20, 2015

(65) Prior Publication Data

US 2015/0267501 A1 Sep. 24, 2015

Related U.S. Application Data

(60) Provisional application No. 61/968,169, filed on Mar. 20, 2014.

(51) Int. Cl.

| | |
|---|---|
| ***E21B 23/06*** | (2006.01) |
| ***E21B 33/127*** | (2006.01) |
| ***E21B 34/10*** | (2006.01) |
| ***E21B 33/12*** | (2006.01) |
| ***E21B 33/138*** | (2006.01) |

(52) U.S. Cl.

CPC ..... *E21B 33/1272* (2013.01); *E21B 23/065* (2013.01); *E21B 33/12* (2013.01); *E21B 33/127* (2013.01); *E21B 33/138* (2013.01); *E21B 34/10* (2013.01)

(58) Field of Classification Search

CPC ..... E21B 29/10; E21B 33/12; E21B 43/105; E21B 23/065; E21B 33/127; E21B 33/1272; E21B 33/138; E21B 34/10

See application file for complete search history.

(56) References Cited

U.S. PATENT DOCUMENTS

| | | | |
|---|---|---|---|
| 2,519,116 | A | 8/1950 | Crake |
| 2,696,259 | A | 12/1954 | Greene |
| 2,804,148 | A | 8/1957 | Schremp et al. |
| 3,055,424 | A | 9/1962 | Allen |

(Continued)

FOREIGN PATENT DOCUMENTS

| | | | |
|---|---|---|---|
| GB | 2251011 | | 6/1992 |
| GB | 2411918 | A | 9/2005 |

(Continued)

OTHER PUBLICATIONS

International Search Report and Written Opinion in International Application No. PCT/US2017/051272, dated Nov. 24, 2017, 12 pages.

(Continued)

*Primary Examiner* — Daniel P Stephenson

(74) *Attorney, Agent, or Firm* — Fish & Richardson P.C.

(57) ABSTRACT

An apparatus for sealing a section of a wall of a wellbore adjoining a target zone containing undesirable fluids for preventing penetration of the undesirable fluids into the wellbore is described. The apparatus includes an inflatable balloon deployable in the wellbore, a coiled tubing for deploying the inflatable balloon into the wellbore and an inflating assembly tool for inflating the balloon to form a seal over the adjacent target zone of the well bore wall.

28 Claims, 13 Drawing Sheets

(56) References Cited

U.S. PATENT DOCUMENTS

| | | | | |
|---|---|---|---|---|
| 3,354,955 | A | 11/1967 | Berry | |
| 3,419,080 | A | 12/1968 | Lebourg | |
| 4,349,047 | A | 9/1982 | Ditto | |
| 4,462,714 | A | 7/1984 | Smith et al. | |
| 5,833,001 | A * | 11/1998 | Song | E21B 29/10 166/187 |
| 6,102,120 | A | 8/2000 | Chen | |
| 6,253,850 | B1 | 7/2001 | Nazzai et al. | |
| 6,860,329 | B1 * | 3/2005 | Oosterling | E21B 23/01 166/207 |
| 7,708,081 | B2 | 5/2010 | Bosma et al. | |
| 8,528,632 | B2 * | 9/2013 | Mack | E21B 33/12 166/106 |
| 2005/0199401 | A1 | 9/2005 | Patel | |
| 2007/0137826 | A1 | 6/2007 | Bosma | |
| 2007/0260439 | A1 | 11/2007 | Keller | |
| 2008/0060813 | A1 | 3/2008 | Badalamenti et al. | |
| 2009/0178809 | A1 | 7/2009 | Jeffryes et al. | |
| 2009/0183875 | A1 | 7/2009 | Rayssiguier et al. | |
| 2012/0055667 | A1 | 3/2012 | Ingram | |
| 2013/0153207 | A1 * | 6/2013 | Lauderdale | E21B 23/02 166/123 |
| 2015/0267501 | A1 * | 9/2015 | Al-Gouhi | E21B 23/065 166/299 |
| 2016/0084059 | A1 | 3/2016 | Moore et al. | |
| 2016/0177659 | A1 | 6/2016 | Voll | |

FOREIGN PATENT DOCUMENTS

| | | | |
|---|---|---|---|
| WO | WO2002099247 | A1 | 12/2002 |
| WO | WO2010127240 | A1 | 11/2010 |

OTHER PUBLICATIONS

International Search Report and Written Opinion in PCT/US2015/021680, dated Sep. 11, 2015, 11 pages.

* cited by examiner

FIG. 1
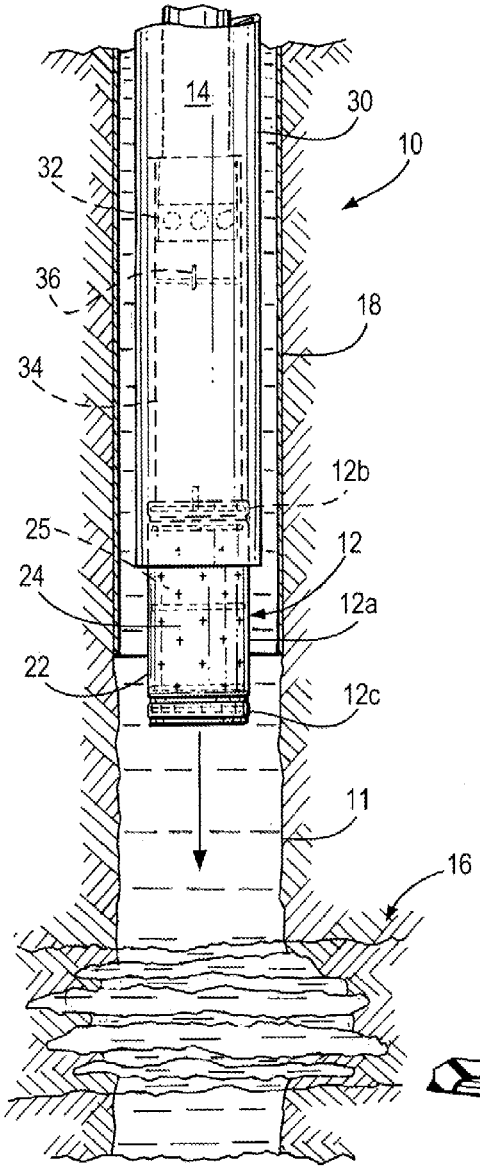
FIG. 3
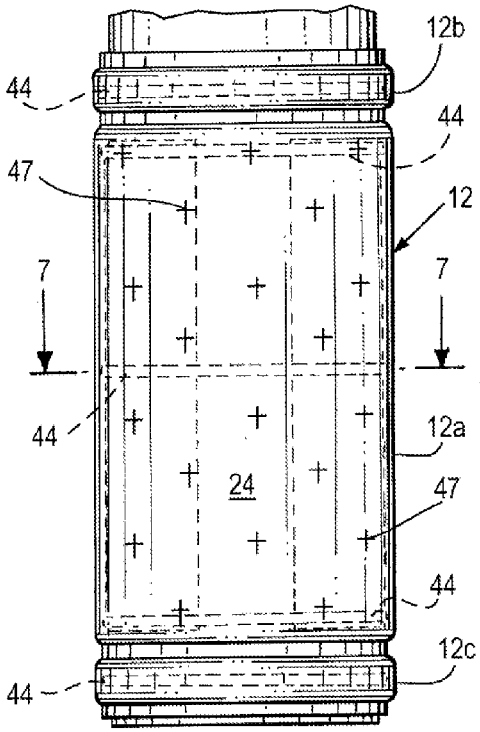
FIG. 4
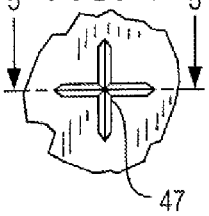
FIG. 5
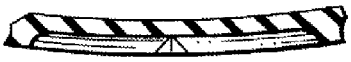
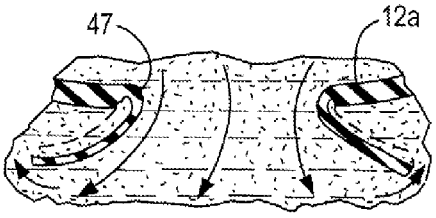
FIG. 6

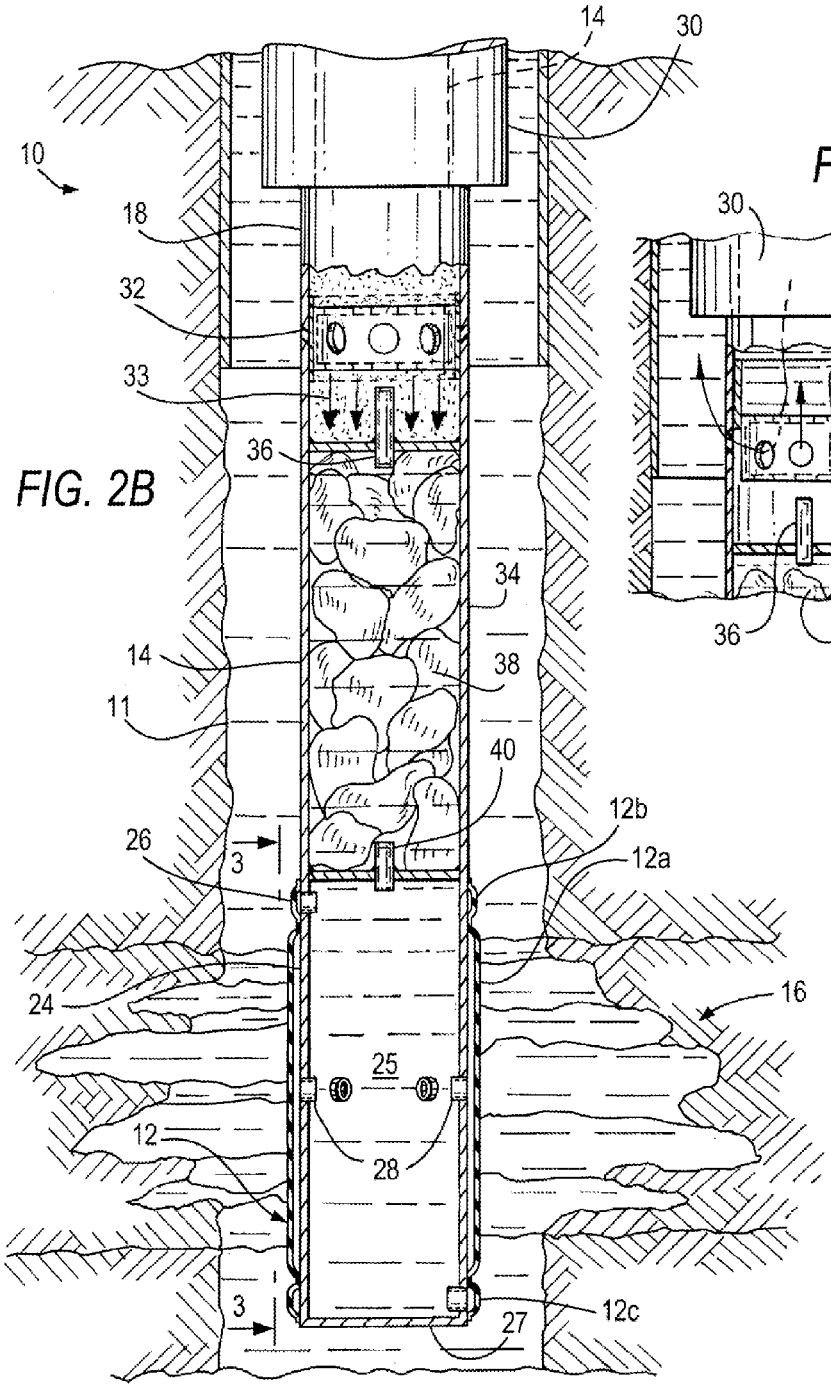
FIG. 2B
FIG. 2A
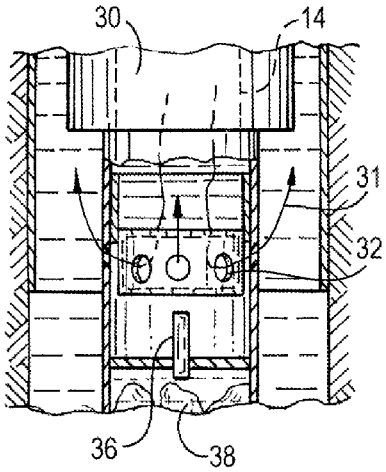

FIG. 7
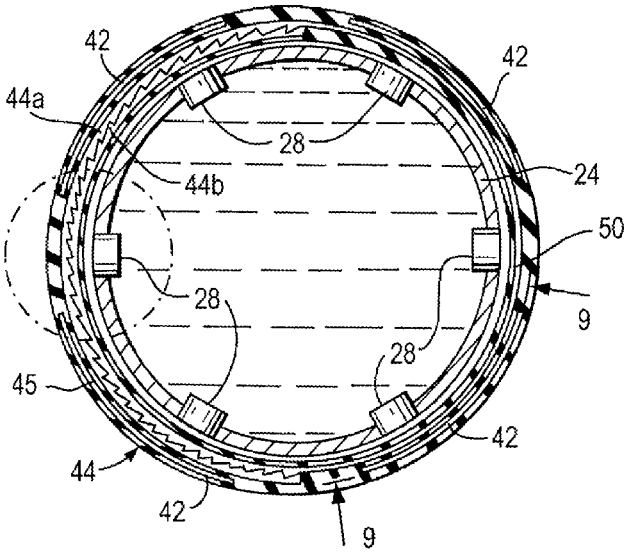
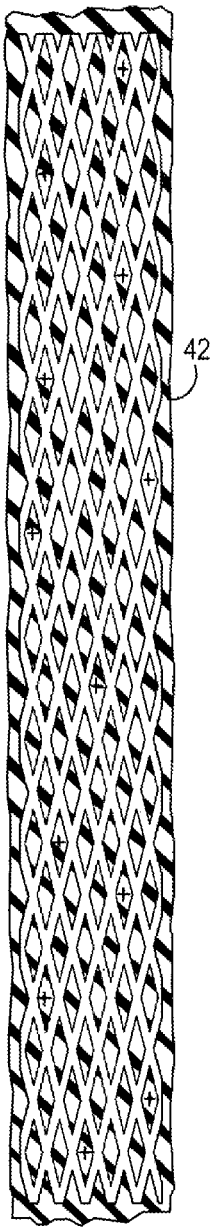
FIG. 9
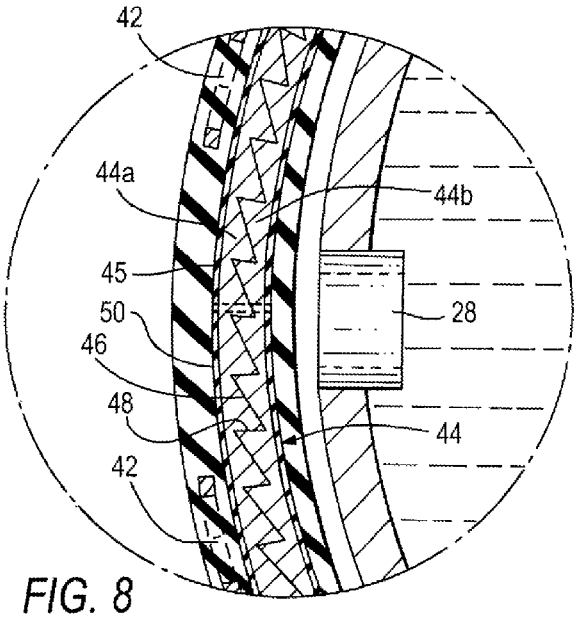
FIG. 8

FIG. 17
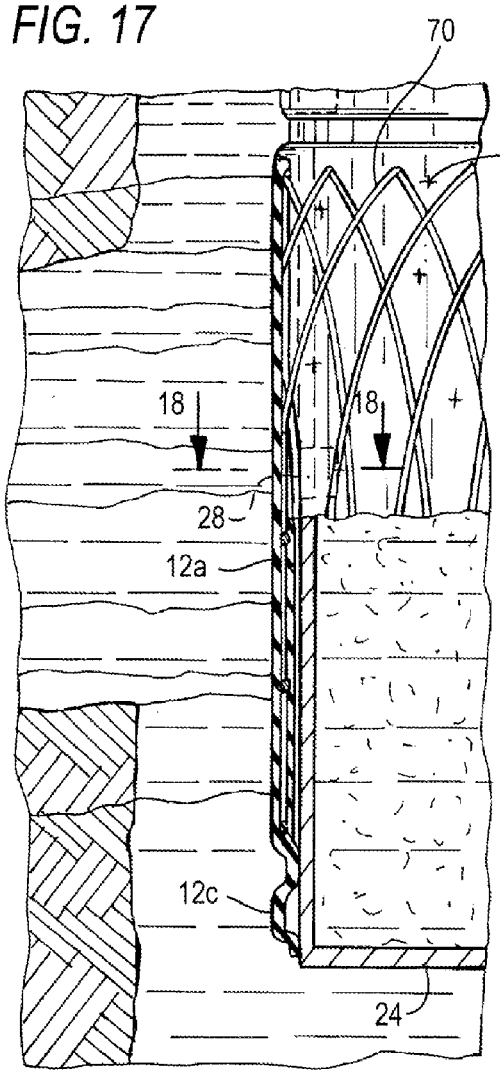
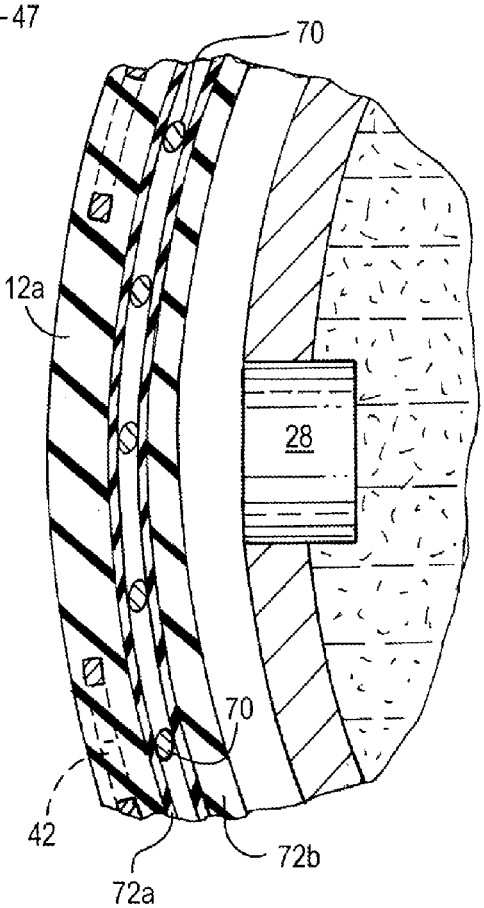
FIG. 18

METHOD AND APPARATUS FOR SEALING AN UNDESIRABLE FORMATION ZONE IN THE WALL OF A WELLBORE

BACKGROUND OF THE INVENTION

1. Field of the Invention

The present invention relates to the intentional inducement of downhole formation damage in a target zone to produce deep plugging of the formation matrix and sealing the zone at the wellbore face.

2. Description of the Related Art

Prediction of formation plugging damage that occurs while drilling wells is an important factor in optimizing an oil field's development. The economic impact of near-wellbore drilling-induced damage and cleanup efficiency has led to significant progress in both experimental and numerical studies in order to assess wellbore flow properties during oil production.

The possibility of causing formation permeability plugging damage exists during operations throughout the life of the well. Wellbore damage can cause a reduction in the natural capability of a reservoir to produce its fluids, such as a decrease in porosity or permeability, or both. Damage can occur near the wellbore face which can be relatively easy to repair or deep into the rock which may be difficult to repair.

Damage can occur when sensitive formations are exposed to drilling fluids. Formation plugging damage in a wellbore is generally caused by several mechanisms which can include the following:

1. physical plugging of pores by drilling mud solids;
2. alteration of reservoir rock wettability;
3. precipitation of insoluble materials in pore spaces;
4. clay swelling in pore spaces;
5. migration of fines into pore throats;
6. introduction of an immobile phase; and
7. emulsion formation and blockage.

In well completions, there are several recognized damage mechanisms, such as the invasion of incompatible fluids swelling the formation clays, or fine solids from dirty fluids plugging the formation matrix. Because damage can significantly affect the productivity of any well, adequate precautions should be taken to avoid such damage during all phases in the life of a well.

Natural or induced impairment to production can develop in the reservoir, in the near-wellbore area or the perforations. Natural damage occurs as produced reservoir fluids move through the reservoir, while induced damage is the result of external operations and fluids in the well, such as drilling, well completion, workover operations or stimulation treatments. Some induced damage triggers natural damage mechanisms. Natural damage includes phenomena such as fines migration, clay swelling, scale formation, organic deposition, including paraffins or asphaltenes, and mixed organic and inorganic deposition. Induced damage includes plugging caused by foreign particles in the injected fluid, wettability changes, emulsions, precipitates or sludges caused by acid reactions, bacterial activity and water blocks. Wellbore cleanup or matrix stimulation treatments are two different operations that can remove natural or induced damage. Selecting the proper operation depends on the location and nature of the damage.

The current practice to shut off a water zone requires a rig to case and cement the entire open-hole and to selectively perforate the oil zone while isolating and maintaining the water zone behind the casing and cement.

In general, formation plugging is considered to be an undesirable phenomenon. The problem to be addressed by the invention is how to utilize these phenomena to plug the porosity and to kill the permeability of a water zone and to retain the oil productive zone in an open hole to allow flow to the wellbore.

SUMMARY OF THE INVENTION

The present invention provides a method and apparatus to shut off an undesirable water zone in an open hole well by intentionally inducing formation plugging damage in the zone. By this method, the benefits associated with producing the oil zone from an open-hole rather than from perforations in cemented casing is maintained. The method and apparatus of the invention employs coiled tubing to deploy the components down hole and thereby avoids the need for a costly rig and other of the requirements of the prior art methods to shut off the water zone.

Thus, the present invention provides a rigless method for sealing off undesirable target zones in an existing open-hole well. An inflatable chemical balloon system that is deployed by coiled tubing is used to induce permanent skin damage to the surface and the adjoining region of the undesirable water zone. In one embodiment of the invention, a specially configured and dimensioned multi-section balloon is used to inject a formation plugging fluid during inflation; following full inflation, the body of the balloon is softened and melted, and retained against the wall of the well in the target zone.

An inflating container assembly is filled with a formation plugging fluid and includes at least one, but preferably a plurality of pressure-operated inflating valves and is surrounded by an inflatable balloon. The inflating valve or valves when open provide fluid communication between the interior of the inflating container and the balloon.

A sealed chemical container is secured above the inflating container and fluid communication between the containers is provided by a normally closed one-way pressure activated valve. The chemical container is provided with a chemical reactant and the inflating container is filled with a formation plugging fluid at the surface, and both are sealed before being deployed downhole. A circulation valve with a programmable timer provides fluid communication between the coiled tubing and the chemical container.

The two containers and the balloon are lowered to the target zone by the coiled tubing, thereby avoiding the need for a rig. Upon introduction of the pressurized fluid chemical reactant into the chemical container through the one-way pressure valve, there is initiated a controlled explosive exothermic chemical reaction above the inflating container. At a preset pressure, the valve to the inflating container opens to pass the exothermic reaction products and displaces the plugging fluid into the central balloon which, first inflates and simultaneously discharges the formation plugging fluid into the annulus of the target zone between the exterior surface of the balloon and the wall of the wellbore. The expansion of the central balloon also forces the formation fluid and the plugging fluid from the annulus into the formation, thereby intentionally inducing formation damage to eliminate or reduce the flow of formation fluids, e.g., water. The heat of the exothermic reaction as conveyed by the hot reaction products, then softens and/or melts the body of the balloon against the wall of the well to provide a permanent barrier or thermoplastic skin to seal off the undesirable zone.

The balloon's materials of construction are similar to the construction of an inflatable packer and can include fabric or wire reinforced rubber or other polymeric materials. As such, the production of the balloon is within the skill of the art. The balloon can be fabricated in accordance with known methods for producing an expandable polymeric product, e.g., as by molding which can also include a vulcanization step as in the production of rubber articles such as, e.g., inflatable well packers, bicycle inner tubes, and the like. The balloon can be provided in a generally cylindrical configuration having an axial opening with an internal diameter to permit the molded element to be slipped over the inflating container to which it is secured, e.g., by an appropriate adhesive that will provide a fluid-tight seal around the top, bottom and interior surfaces which divide the three-section balloon into separately inflatable chambers.

The central balloon can advantageously include one or more of the following structural elements:

a. straps or bands of a rigid high tensile strength material, e.g., a metal diamond mesh, embedded in the body and aligned with the longitudinal axis of the balloons;
b. an expandable ratchet ring positioned within an open-ended tube which is positioned transverse to the longitudinal axis and secured to the interior of the balloon to maintain it in position against the wall of the well after the maximum expansion of the balloon has occurred; and
c. an expandable metal stent positioned in the interior of the balloon and aligned with longitudinal axis to maintain the inflated balloon against the wall to form the seal.

The ratchet ring has overlapping teeth in the internal opposed facing sides of the overlapped surfaces which permit unidirectional expansion. The teeth are uniform, but asymmetric, with each tooth having a moderate slope on one side and a much steeper slope on the other side. The moderate slope allows the overlapped part to slide during expansion of the ring, and the steeper slope prevents the ring from collapsing after expansion. As noted above, the ratchet ring is contained inside a flexible, extendable tube with an opening, whereby two ends face each other when the tube is relaxed. The flexible circular tube keeps the teeth of the ratchet ring aligned, and the opening of the tube allows expansion of the ring inside of it.

In an alternative embodiment, the central balloon can be strengthened by an expandable wire stent similar to those used in medical applications for coronary stenting. The stent is embedded in the wall of the balloon between a pair of extendable polymer webs so that as the balloon is inflated by formation plugging fluid and chemical reaction products the stent can expand to thereby reinforce and support the balloon against the wall of the wellbore and maintain an effective seal.

In order to facilitate the separation of the portions of the central balloon secured to the inflating container from the outer wall of the central section following the full expansion and melting of the portion that is in contact with the wall of the wellbore, the originally molded balloon can be produced with weakened circumferential top and bottom sections that will soften and provide a highly elastic margin between the portion that is sealed and retained against the wellbore wall and the remaining margins that remains attached by adhesive to the inflating container.

Similarly, the upper and lower sections of the balloon which initially inflate to provide a seal with the wellbore wall and provide barriers to the flow of the formation plugging fluid from the central balloon can also be provided with one or more weakened areas that will result in their rupture under the force of a predetermined pressure that is subsequently delivered from the surface via the coiled tubing. The weakened areas can be produced by reducing the thickness of the polymer wall. Alternatively, the entire upper and lower balloons can be fabricated from a different polymeric composition having properties that will permit its more rapid expansion and eventual rupturing under the downhole conditions of pressure and temperature.

The polymeric formulation(s) for the respective sections of the balloon are chosen to produce the desired characteristics under the initial already elevated downhole temperature at the target zone, which is predetermined by conventional well logging techniques. The formulation also takes into account the increase in temperature of the already heated balloon produced by the exothermic chemical reactants which eventually come into contact with the interior surface of the zone sealing portion of the balloon to raise its temperature to the softening/melting point while it is fully expanded against the wall of the wellbore.

The chemical balloons have the capability of being inflated to contact the wall of the wellbore with the assistance of the expansive force created by the exothermic chemical reaction. After reaching the wall, the central balloon responds to the heat of the reaction products to soften and preferably melt against the wall of the well and create permanent skin damage, i.e., the sealing of the surface of the target zone. The selection and adaptation of existing chemical reactants to effect the method of the present invention is within the skill of the art;

The central balloon can be fitted or integrally formed with a single weakened diaphragm or a number of weakened areas spaced apart over its surface that will rupture at the start of inflation and permit the passage of the pressurized formation plugging fluid that is inside the inflating container, while also allowing the balloon to fully inflate and reach the wall of the wellbore. Alternatively, one or more pressure-activated one-way valves can be provided in the wall of the central balloon to pass the pressurized plugging fluid. The upper and lower balloons are configured to inflate faster than the central balloon to provide a fluid-tight annular compartment against the wall of the well. The central balloon inflates at a slower rate than the adjacent balloon because in an embodiment, the central balloon has one or more valves or a number of weakened areas which are ruptured at the start of inflation to form openings to allow the passage of the formation plugging fluid as the central balloon is inflating. After inflating the central balloon and forcing the formation plugging fluid and any residual wellbore fluid into the formation, the reaction products and the pressure of the explosive force will soften and melt the central balloon causing it to adhere to the wall of the well.

A circulation valve with a timer is attached in fluid communication to the end of the coiled tubing. The downhole end of circulation valve is attached via a pressure-operated inlet valve to the chemical container. The timed circulation valve is used to circulate wellbore fluid to the surface via the coiled tubing while the balloon assembly is lowered through the production tubing. When the apparatus is in position at the target zone, the fluid reactant is pumped down to the circulation valve and any wellbore fluid is displaced through the open circulation valve. At a predetermined time, the circulation valve is closed when it is calculated that the fluid reactant reaches the depth of the circulation valve. The pressure in the coiled tubing is increased, and the fluid reactant passes through the one-way pressure-operated valve into the chemical container. A closed automated system is thus provided to inflate the balloons. Adaptations of commercial timed circulation valve systems which are suitable for use in the method of the present invention are within the skill of the art.

The chemical container is placed below the circulation valve and contains the chemicals required for the exothermic reaction that provides the heat and controlled explosive force. The chemical container is fitted with a pressure-operated inlet valve located at the top of the container in fluid communication with the tubing. The valve opens at a predetermined pressure applied from the surface to initiate the exothermic reaction inside the container after entry of the fluid reactant via the coiled tubing.

A pressure-operated exit valve at the bottom of the chemical container allows the pressurized reaction products to enter the inflating container. A chemical reactant, e.g., sodium metal particles or other suitable reactive material, is placed in the chemical container at the surface and sealed.

The pressure-operated inflating valves open to inflate the three balloons. Alternatively, the pressure-operated inflating valves can be replaced with RFID valves which operate by radio frequency and pumped tags, such as Omega valves. However, pressure-operated inflating valves as described herein are preferred.

The circulation valve timer is set to account for the time required to pump the liquid chemical from the surface to the circulation valve depth. When the fluid reactant reaches the circulation valve depth, the circulation valve closes and the system is pressurized from the surface to open the pressure-operated valve to the chemical container and initiate the reaction. The rapid exothermic reaction increases the pressure in the chemical container to open the valve and allow the reaction products to enter the inflating container and begin displacing the formation plugging fluid from the inflating container.

As noted, the formation plugging fluid is initially contained in the inflating container and is displaced by the highly pressurized, hot reaction products coming from the chemical container above it. As it is displaced, the wall plugging fluid inflates the balloons and fills the upper and lower balloons completely until they expand to positions in contact with the wall of the wellbore. The displaced formation plugging fluid will inflate the upper and the lower balloons faster than the central balloon because the central balloon has an opening in the diaphragm causing it to rupture. The central balloon has at least one valve for discharging fluids, but preferably a plurality of weakened areas that rupture during the expansion of the central balloon, through which the displaced plugging fluid passes into the annulus. The valve(s) or openings in the body of the central balloon allow the passage of a controlled amount of the formation plugging fluid from the inflating container to the outside of the balloon, while at the same time, containing to inflate the balloon, but at a slower rate than the upper and lower balloons.

The central balloon is in contact with the wall of the wellbore after its maximum inflation. As the balloon expands, it pushes the original wellbore fluid and the formation plugging fluid that was inside the inflating container deep into the formation. In this step, the body of the balloon in contact with the hot reaction products resulting from the exothermic reaction initiated in the chemical container. The heat softens and preferably melts the central balloon and forces it against the wall of the well where the balloon is maintained by the expanded ratchet ring. The upper and lower balloons maintain a sealed annular chamber at the target zone. They are not affected by the exothermic reaction products because they are inflated by the formation plugging fluid and there are no openings in them permitting the plugging fluid to escape.

After the target zone has been sealed, additional pressurized fluid is pumped into the coiled tubing from the surface to the upper and lower balloons via the containers and intermediate valves until they rupture to thereby enable the apparatus to be retrieved via the coiled tubing through the production tubing.

In an alternative embodiment of the system and method of the invention, the upper and lower balloons that isolate the target zone when inflated are replaced by a dual inflatable packer system. Each of the packers can be inflated with wellbore fluids by separate electric pumps. The upper inflatable packer and its associated electric pump are positioned above the circulation valve, while the lower inflatable packer and its associated electric pump are positioned below the inflating container. The inflatable section is constructed of a reinforced rubber composition for durability during repeated usage of the assembly. Electrical wiring extends to the wellhead where controls for the pumps are provided. Inflatable packers are well known in the art and can be adapted by one of ordinary skill for use in the invention.

A suitable inflatable packer system is commercially available from Schlumberger under the designation Dual-Packer Module (MRPA) which can be inflated using that company's Pumpout Module (MRPO). This model includes an autoretract mechanism which applies a longitudinal tensile force to assist in retracting the packers after deflation, thereby minimizing drag when the assembly is withdrawn. It is reported in the Schlumberger commercial literature for this system that at temperatures below 107° C./225° F., the inflatable elements retain sufficient elasticity for operation without the retractor mechanism.

As in the embodiment utilizing the upper and lower balloons, the upper and lower inflatable packers are inflated prior to inflation of the central balloon in order to isolate the target zone. The central balloon is inflated in the same manner as the above-described embodiments. Following the full expansion and melting of the central balloon to seal the wall in the target zone, the upper and lower packers are deflated using the electrical pumps and the apparatus is removed from the wellbore via the production tube. In this embodiment, the central balloon can include one or more of the structural elements discussed above such as the straps or bands of rigid high tensile material, the expandable ratchet ring, and the expandable metal stent.

A used in this description and in the claims, the term "balloon" refers to an inflatable member that is positioned at, or adjacent to the target zone that is to be treated prior to being inflated and includes an inflatable packer that can be inflated with wellbore fluids using an associated electric pump. The balloon is preferably mounted coaxially with the longitudinal axis of the coiled tubing and symmetrical in its transverse cross-section. The balloon is preferably dimensioned and configured to expand uniformly to securely engage the surrounding wall of the wellbore once the balloon is fully inflated and thereby center and stabilize the assembly of which it is an integral member so that it resists movement by longitudinal forces.

BRIEF DESCRIPTION OF THE DRAWINGS

Preferred embodiments of the invention are described in more detail below and with reference to the drawings in which:

FIG. 1 is an elevation view, partially in cross-section, of an apparatus constructed according to the present invention, the chemical balloon having three inflatable sections being deployed in an open-hole section of wellbore supported by coiled tubing and positioned below the end of the production tubing, the wellbore having an undesirable water zone and being filled with formation fluid or other completion fluid denoted herein as "wellbore fluid";

FIG. 2A is an enlarged partial cross-sectional view of an upper portion of the apparatus of FIG. 1, illustrating the displacement of wellbore fluid through the circulation valve once the apparatus has been lowered to the target zone;

FIG. 2B is an enlarged partial cross-sectional view of the components of the apparatus of FIG. 1, illustrating the mechanism used for initiating the chemical reaction which expands the central balloon;

FIG. 3 is an enlarged side elevation view of the multi-section chemical balloon which forms part of the apparatus of FIG. 1 and delivers formation plugging fluid to the target zone;

FIG. 4 is an enlarged fragmentary view of a section of the central balloon shown in FIGS. 1 and 3, illustrating one of several weakened sections of the balloon that permit wall formation plugging fluid material to pass from the inflating container and through the weakened sections of the central balloon to penetrate the formation and seal the target zone while the balloon is inflating;

FIG. 5 is a cross-sectional view, taken along lines 5-5 of FIG. 4, showing a portion of the weakened central balloon wall having a reduced thickness;

FIG. 6 is a partial cross-sectional view of a portion of the central balloon wall shown in FIGS. 4 and 5, when ruptured during inflation allowing the pressurized formation plugging material reaction products to pass through the balloon wall into the annulus to seal the target zone;

FIG. 7 is a cross-sectional view, taken along lines 7-7 of FIG. 3, illustrating an embodiment of the invention in which two or more expandable ratchet rings are embedded in the central balloon to provide circumferential rigidity to selected portions of the balloon as it expands during the chemical reaction and to maintain it in the fully expanded position against the wellbore wall following expansion;

FIG. 8 is an enlarged view of the indicated portion of FIG. 7 illustrating the engagement of the ratchet rings;

FIG. 9 is a cross-sectional view, taken along lines 9-9 of FIG. 7, of one embodiment of a rigid reinforcing band in the form of a diamond-shaped mesh metal strip embedded in the central balloon material to provide rigidity in the longitudinal direction to complement the circumferential rigidity provided by the expandable ratchet rings shown in FIGS. 3 and 7;

FIG. 17 is an elevation view, partly in cross-section of another embodiment illustrating the inclusion of an expandable wire stent device in the un-inflated balloon which will maintain the fully expanded central balloon against the wall of the wellbore.

FIG. 18 is a cross-sectional view, taken along lines 18-18 of FIG. 17, showing the expandable wire stent device positioned between two extensible webs of a polymeric material that are embedded in the wall of the central balloon;

DETAILED DESCRIPTION OF THE PREFERRED EMBODIMENTS

Figure 11:
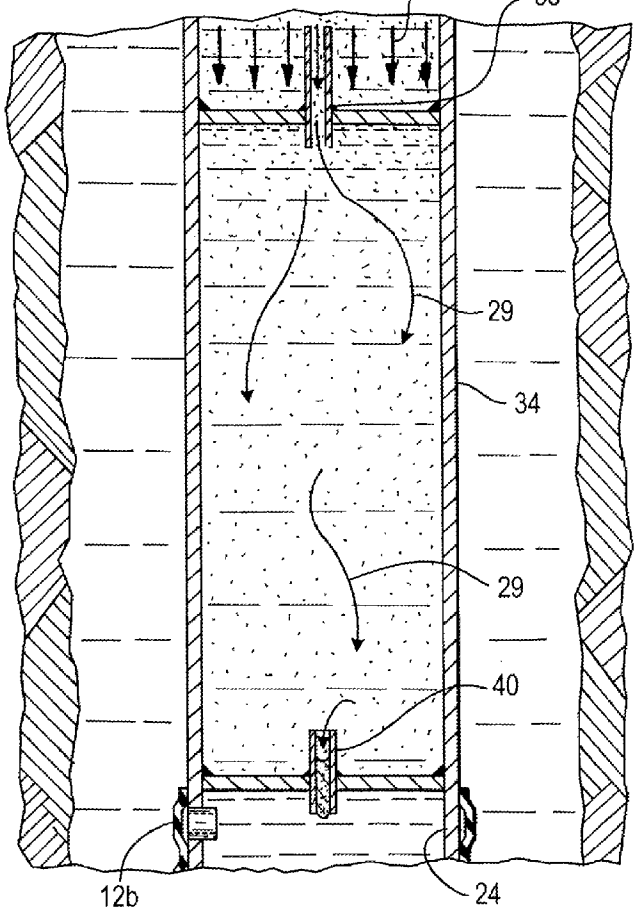
FIG. 11 is a cross-sectional view of the chemical container shown in FIGS. 2 and 10 in the process of initiating the reaction prior to discharging the pressurized reaction products via the lower pressure valve to inflate the balloons.

Referring now to the drawings, and specifically to FIG. 1, there is shown in elevation and partially in cross-section, an apparatus 10 constructed according to one embodiment of the present invention. The apparatus includes a resilient inflatable component, referred to generally as balloon 12, which is comprised of a plurality of sections and, as illustrated, of three sections, there being a central section 12*a*, referred to as the main or middle, or central balloon, an upper balloon 12*b*, and a lower balloon 12*c*. In the description which follows, reference to balloon 12 contemplates the balloon in its entirety, including the three sections, 12*a*, 12*b* and 12*c*, where balloon 12*a* is the central or middle balloon. The three sections are inflated according to a predetermined sequence as will be described in greater detail below.

The un-inflated balloon 12 and related components described below are deployed in the wellbore 11 by coiled tubing 14 which passes through production tube 30 until it reaches target zone 16 of the wellbore. For purposes of describing this embodiment, target zone 16 will be denoted as an "undesirable" water zone. In FIG. 1, undesirable target zone 16 is located deeper in the wellbore 11 than the lowermost end 22 of production tubing 30 and well casing 18.

The undesirable zone 16 may also represent a lateral drill hole which may be horizontal or angled, and which may have been partially damaged by one or more of a number of factors, including, but not limited to, contact with wellbore fluids used during drilling/completion and workover operations. It is a zone of reduced permeability within the vicinity of the wellbore 11 (i.e., skin), often the result of foreign fluid invasion into the reservoir rock.

The three balloons 12*a*, 12*b* and 12*c* can be made of any suitable flexible thermoplastic expandable material, i.e., a polymer, and preferably rubber, natural or synthetic. Different flexible and resilient materials can be used for each of the three balloons and/or the individual balloons can be produced with different wall thicknesses, physical properties and means for attachment to their supporting surface. The thickness and resiliency of the walls, or sections of the walls of the respective balloons is sufficient to permit the expansion and secure contact with the adjacent wall surface.

As will be described in greater detail below, the balloons 12 are inflated via an exothermic reaction in the chemical container 34 which is initiated by the pumping of a predetermined volume of a fluid reactant 33 (not shown) from the surface via the coiled tubing 14 and through the upper pressure-operated inlet valve 36 into the chemical container 34 and into contact with one or more reactant material(s) loaded in the chemical container 34 during preparation of the apparatus before it is lowered into the wellbore 11. The inflating container 24 is also filled at the surface with formation plugging fluid 25 and has at least three inflating ports. In the preferred embodiment, the three balloons are secured in position on the outside surface of the inflating container 24, e.g., by an adhesive. The central balloon preferably has a plurality of weakened areas that will rupture at the early stages of inflation. After rupturing, the weakened wall will allow the passage of the formation plugging fluid from the inflating container 24 while allowing the balloon 12 to inflate and expand radially into the annular space or compartment defined by the adjacent balloons.

The upper and lower balloons 12*b* and 12*c* will inflate first to provide tight seals against the wall of the well at either end of the central balloon, thereby acting as barriers to the plugging fluid 25. This fluid-tight compartment will permit the formation plugging fluid 25 to be forced deep into the formation under the pressure produced by the hot rapidly expanding reaction product. As noted, initially, the wellbore 11 is filled with formation fluids or other completion fluids which are referred to herein as "wellbore fluid."

Referring now to FIGS. 2A and 2B in conjunction with FIG. 1, the balloon 12 is positioned and supported by inflating container 24, which includes a plurality of inflating valves 26, 27 and 28, which, when open, permit passage of the formation plugging fluid 25 under pressure, and expand the three sections 12*a*, 12*b* and 12*c* of balloon 12 when the reaction products from above enter the container 24 is described in greater detail in the discussion of FIGS. 11-14.

Referring again to FIGS. 2A and 2B in conjunction with FIG. 1, the assembly of the invention includes coiled tubing 14 deployed via production tubing 30 into the borehole which is attached at its lower end to timed circulation valve 32 which in turn, is attached to chemical container 34, which is secured in fluid communication via pressure valve 40 to inflating container 24. The circulation valve can be any type of programmable circulation valve which is manufactured for oil drilling applications, such as the Halliburton eRED-HS® Remotely Operated Circulating Valve or the Omega Remote Completion Circulating valve. The timed circulation valve 32 is kept open while the tool is lowered into the borehole so that wellbore fluids enter the coiled tubing, thereby facilitating deployment of the assembly through production tubing 30.

The chemical container 34 can contain any suitable chemical reactant(s) 38 that can be activated to produce an exothermic reaction and preferably provide a limited or controlled "explosive" expansion by the addition of a fluid reactant as an activating medium. In the present example, the chemical container 34 preferably houses a supply of pure solid reactant material, such as sodium metal 38, which can later be activated by an appropriate amount of water delivered via the coiled tubing from the surface under pressure to initiate the necessary reaction with sufficient force to rapidly expand the rubber balloons 12. For safe handling, the sodium metal can be submerged in kerosene or other non-reactive liquid in the sealed chemical container 34. Other appropriate known reactant materials are contemplated as within the scope of the invention, provided that they are capable of producing a rapid exothermic reaction.

Once the balloon 12 reaches the target zone 16, a predetermined volume of activating fluid reactant 33 that is required to complete the highly exothermic reaction with the chemical(s) inside the chemical container 34 is pumped into the coiled tubing 14 from the surface. The fluid reactant is followed by a displacing liquid (not shown) which is pumped into the coiled tubing 14 to displace wellbore fluids 31 through the timed circulation valve 32 as is illustrated in FIG. 2A. The timed circulation valve 32 is programmed so that the circulation valve timer (not shown) accounts for the time required for the activating fluid reactant 33 to be pumped from the surface to the circulation valve depth. When the fluid reactant 33 reaches the timed circulation valve 32, pumping may be stopped while the timed circulation valve 32 automatically closes, after which, additional displacing fluid is pumped into the coiled tubing to raise the pressure to a sufficient level to open pressure-operated inlet valve 36 which is positioned on chemical container 34. Alternatively, the flow of fluids may be continuous and the circulation valve will automatically change the flow pattern to permit the fluid reactant to develop sufficient pressure to open valve 36.

Referring again to FIG. 2B, the pressure-operated inlet valve 36 is set to open at a predetermined pressure, thereby allowing the activating fluid reactant 33 (e.g., water) to enter the chemical container 34 and react with the reactant chemical, e.g., sodium 38, initiating the controlled explosive reaction within chemical container 34.

Pressure-operated exit valve 40 is positioned at the bottom of the chemical container 34 and communicates with the inflating container 24. The pressure-operated exit valve is set to open under the pressure generated by the chemical reaction and permit the hot pressurized reaction products to enter the inflating container 24.

Upon entry of the reaction products into inflating container 24, the three pressure-operated inflating valves 26, 27, and 28 open to permit the formation plugging liquid 25 to exit the inflating container and begin inflating the three sections of the balloon 12 according to the predetermined sequence described above. The central balloon 12*a* inflates at a lower rate because of its relatively greater volume, while the adjacent smaller balloons 12*b* and 12*c* will be fully inflated first and provide the required seals with the wellbore wall to isolate the target zone 16. This filling sequence can also be achieved by varying the size or flow rate of the plugging fluid through the valves to the respective balloons 12*b* and 12*c*, and/or by lowering the pressure setting at which the valves 26 and 27 open. With reference to FIG. 3, the formation plugging fluid begins to pass through the weakened sections 47 in the central balloon 12*a* as the pressure and volume inside increases. As will be described in greater detail below, the expandable ratchet rings 44 also expand to provide circumferential support following the completed inflation of the central balloon 12*a* against the wall.

The functioning of the weakened sections 47 in the central balloon 12*a* is illustrated in FIGS. 4-6. FIG. 4 is an enlarged view of weakened section 47 of the central balloon 12*a*. As shown in FIG. 5, a cross-sectional view taken along lines 5-5 of FIG. 4, the balloon wall is of a reduced thickness. As shown in FIG. 6, the rupturing of the weakened section 47 of the balloon wall allows formation plugging fluid to escape through the balloon wall 12*a* in order to seal the target zone.

Figure 13:
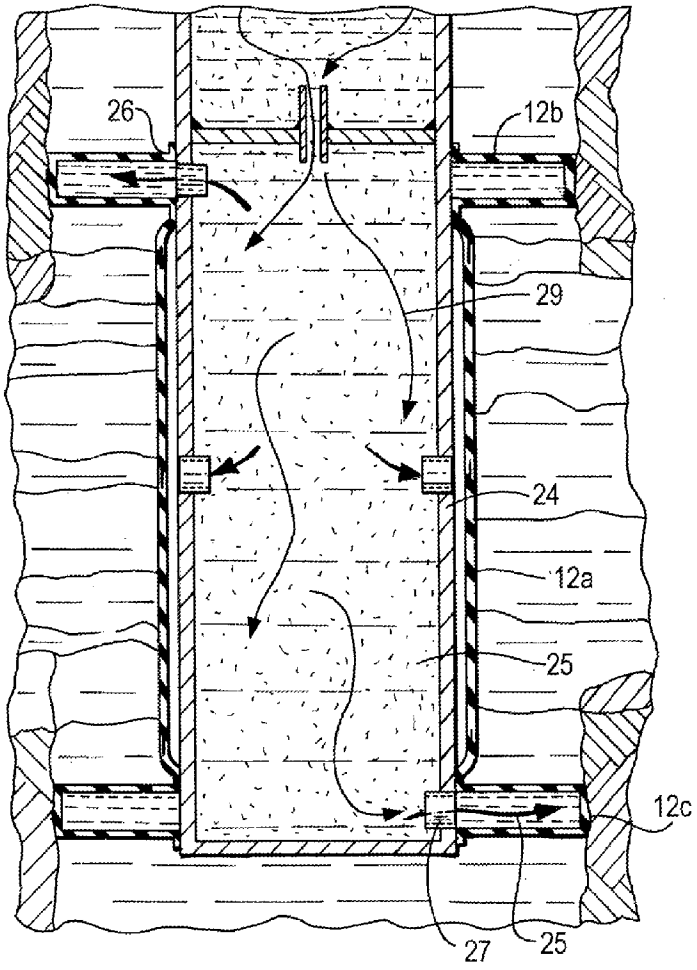
FIG. 13 is a cross-sectional view similar to FIGS. 11 and 12, illustrating the inflating of the three balloons at an intermediate stage with the upper and lower barrier balloons fully inflated in sealing contact with the wellbore wall to form a compartment with the central balloon partially inflated.

Again referring to FIG. 2B, in a further preferred embodiment, inflating valves 26, 27 and 28 can be of different sizes and/or permit different flow rates in order to more rapidly inflate balloons 12*b* and 12*c*. The inflating valves 26, 27 and 28 are opened by controlled explosive force of the chemical reaction, and permit the reaction products to displace the plugging fluid and the balloons 12*b*, 12*c* and 12*a* to displace the formation plugging liquid in the inflating container 24, and to inflate to their positions in contact with the wall of the wellbore 11 as best shown in FIG. 13. Upper and lower balloons 12*b*, 12*c* are end balloons which inflate faster than central balloon 12*a* and provide stability to the entire installation while sealing the upper and lower spaces between the inflating container 24 and the wellbore 11. Although pressure-operated inflating valves 26, 27 can open at the same time as pressure-operated valve 28, expansion of central balloon 12*a* is not to be as rapid as upper and lower balloons 12*b* and 12*c*.

It should be noted that alternative valve arrangements, such as pre-programmed RFID tags operated by radio frequency and pumped tags provided from the surface with prior art electronically actuated valves such as Omega valves, can also be incorporated into the present invention by one of ordinary skill in the art. However, the pressure-operated valves as described above, are presently preferred. The pressure operated valve is a conventional injection-pressure-operated valve such as those manufactured by Schlumberger and Halliburton.

As noted above, the openings 47 in the sidewall of the body of the central balloon 12*a* will allow the passage of the pressurized formation plugging fluid from the inflating container 24 into the annulus between expanding balloon 12*a* and the wellbore wall, while also causing the balloon to inflate at a slower rate than the upper and lower balloons, 12*b* and 12*c*.

Figure 14:
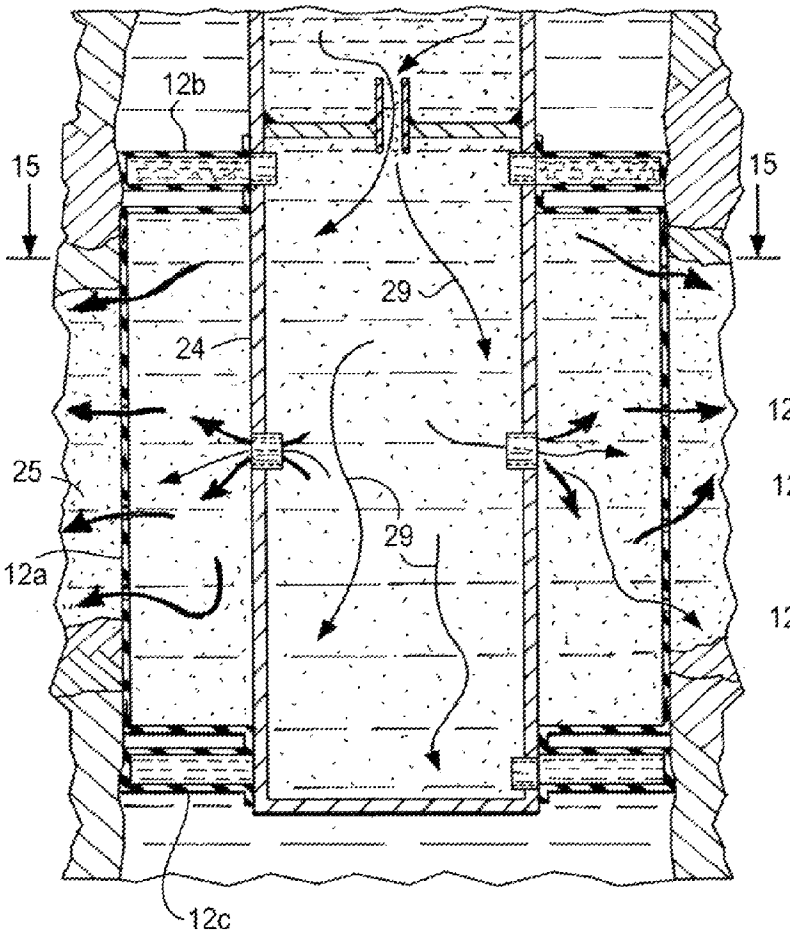
FIG. 14 is a cross-sectional view similar to FIG. 13 illustrating the sequential entry of the reacting chemicals and displacement of the formation plugging fluid into the central balloon via the inflating valves located in the sides of the inflating container that supports the balloons, to expand the upper and lower balloons, and permit the plugging fluid to pass through the ruptured weakened portions of the central balloon and penetrate the formation after which the hot reaction product softens and melts the balloon while it is against the wall of the well to seal off the target water zone.

The formation plugging fluid 25 is initially in the inflating container 24. As shown in FIG. 14, the formation plugging fluid 25 is displaced to the inflating container through inflation valves 26, 27 and 28 by the force or pressure produced by chemical reactants 29 coming from the chemical container 34 above it and with which it is in fluid communication. As it is displaced, the formation plugging fluid 25 and the chemical reactants 29 inflate the balloons 12*a*, 12*b* and 12*c*, and enter the annulus through the one or more openings 47 in the central balloon. The formation plugging 25 fluid can be of any suitable known type that is consistent with and functions to seal the particular formation well under the prevailing conditions. The wellbore fluid originally in the annulus 19 will be displaced into the pores and fissures of the adjacent reservoir rock by the formation plugging fluid 25 as it enters the annulus 19 from the openings 47 in the central balloon 12*a*.

Figure 16:
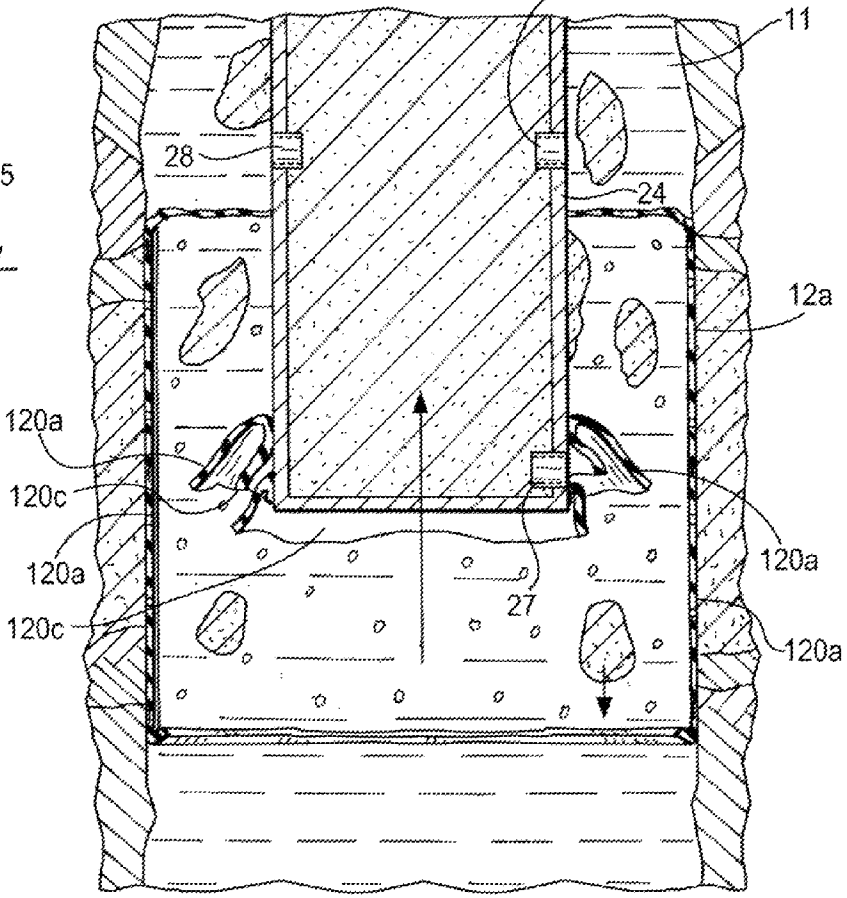
FIG. 16 is a cross-sectional view similar to FIG. 14 showing the completion of the wall sealing process and the partial withdrawal into the production tubing of the coiled tubing, the inflating container, the chemical container, and the residual material of the upper and lower balloons following their rupture.

As shown in FIG. 16, after inflation of the central balloon 12*a*, and forcing the formation plugging fluid 25 into the formation wall, the hot reaction products 29 will cause the central balloon 12*a* to burst at its upper and lower periphery, soften and melt against the wall of the wellbore 11. A large portion of the central balloon 120*a* will be melted and in full contact with the wall of the well after its maximum inflation. The longitudinal portion of the central balloon is thus separated from attachment to the exterior of the inflating container.

With reference to FIG. 14, the structure of the upper and lower balloons 12*b*, 12*c* are stronger than the structure of the central balloon 12*a* due to the plurality of weakened sections 47 which are ruptured when the reaction takes place. The weakened sections 47 in the central balloon 12*a* will also permit the wall plugging fluid to pass through the ruptured portions and penetrate the wall behind the elastomeric polymer material of the central balloon 12*a*.

Figure 15:
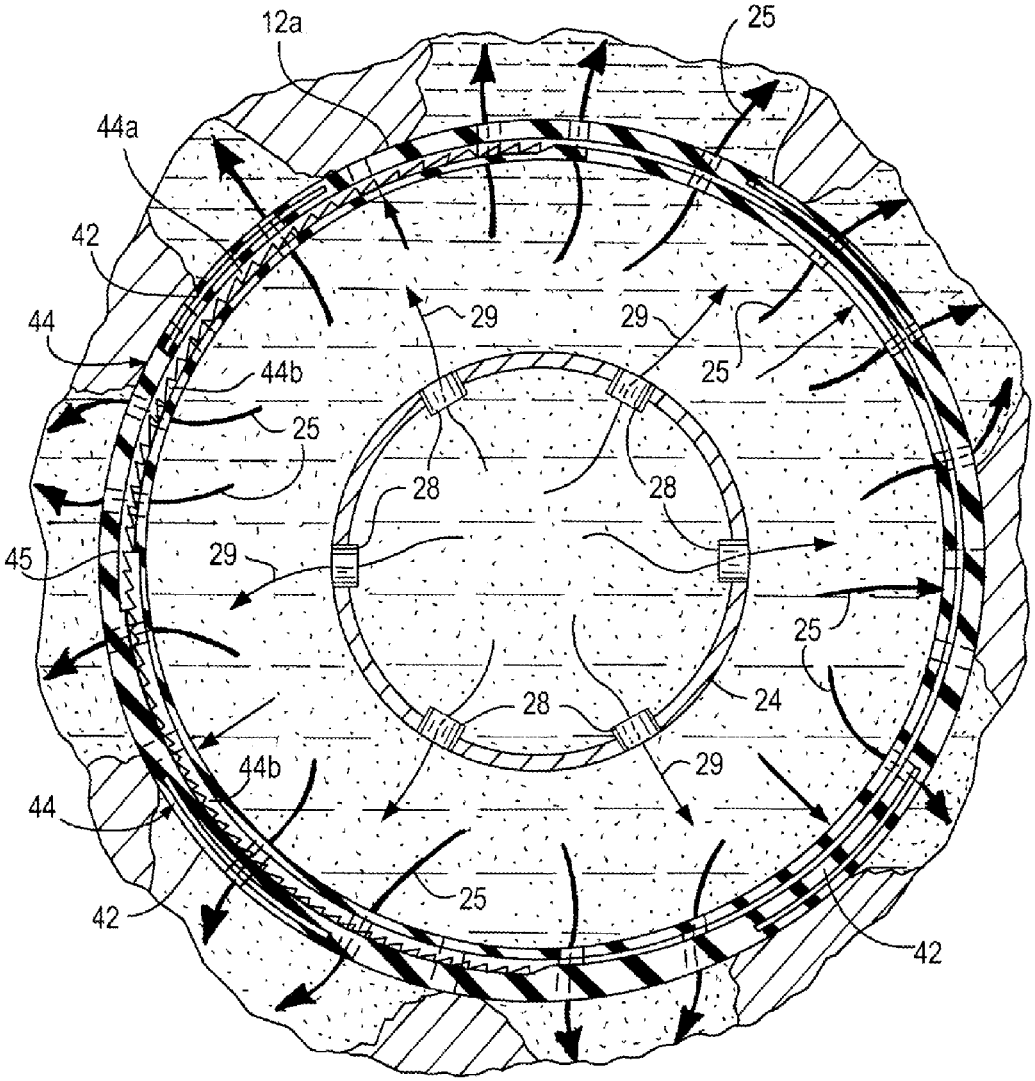
FIG. 15 is a cross-sectional view, taken along lines 15-15 of FIG. 14, illustrating the expanded and separated melted portion of the central balloon and the corresponding expansion of the toothed ratchet ring outwardly to a position which stabilizes and maintains the expanded diameter of the separated portion of the central balloon, with the diamond mesh providing stability in the longitudinal direction.

Referring to the stage illustrated in FIG. 15, as the central balloon 12*a* expands, it pushes the original wellbore fluid and the formation plugging fluid that was inside the inflating container 24 deep into the formation.

At this stage of the process, the body of the central balloon 12*a* is fully exposed to the heat generated in the exothermic chemical reaction from chemical container 34 directly above it. As noted, the heat of the reaction product melts the central balloon 12*a* against the wall of the well, and at the same time, it will be retained in position by the expandable ratchet rings 44 and supported longitudinally by the rigid bands or straps 42.

The upper and lower balloons 12*b*, 12*c* are not affected by the exothermic reaction because they are initially fully inflated by the formation plugging fluid and there is no aperture in either of these annulus-sealing balloons through which the plugging fluid can escape.

Again referring to FIG. 16, after the completion of the wall sealing or plastering step, pressurized fluid is pumped from the surface through the coiled tubing to rupture the upper and lower balloons 120*b* (not shown), 120*c* to enable the apparatus to be retrieved through the production tubing 30.

After the parting of the central balloon 120*a* and the bursting of the upper and lower balloons 120*b*, 120*c*, the coiled tubing can be withdrawn from the wellbore 11 with the remnants of the central, upper and lower balloons 120*b*, 120*c*, leaving the principal portion of central balloon 120*a* in position to seal the undesirable water zone of the wellbore 11.

Referring to FIGS. 7-9, at least the central balloon is preferably strengthened both circumferentially and longitudinal by the addition of reinforcing components. For longitudinal rigidity, a plurality, e.g., four or more rigid reinforcing bands or straps 42, e.g., of metal diamond mesh, are embedded in the polymeric material in spaced-apart relation about the periphery as shown in FIGS. 7-9.

For circumferential strength, an expandable ratchet ring 44 is positioned within opened-ended tube 45 which is embedded in, or bonded to the interior surface of the circumference of the central balloon 12*c*. It is preferable to position ratchet right ring at either end of the central balloon to hold it firmly in position when expanded against the wall above and below the target zone. One or more additional transverse ratchet rings can be provided based on the longitudinal length of the target zone that must be covered by central balloon 12*c*.

The expandable ratchet ring 44 is comprised of two metal rings 44*a*, 44*b*, having overlapping teeth on the inner facing sides as best shown in FIG. 8. The teeth are generally uniform, but asymmetric, with each tooth having a moderate angular slope 46 on one side, and a steeper slope 48 on the other side. The moderate angular slope 46 on one side allows the overlapping teeth to slide over each other during expansion of the balloon 12, and the steeper slope 48 prevents the ring 44 from collapsing after expansion of balloon 12, and retains the supporting ring 44 in the expanded configuration. As noted, and as best shown in FIG. 8, the ratchet ring 44 is contained inside an open-ended flexible circular tube 45, the ends of the opening 50 initially facing each other. The flexible tube 45 constrains the ratchet ring 44 and keeps the teeth of the ratchet ring 44 in engagement at all times after expansion of the central balloon 12*a*. The opening 50 of the tube 45 allows the expansion of the ring inside the tube, as the two facing ends of the tube opening move away from each other.

Figure 19:
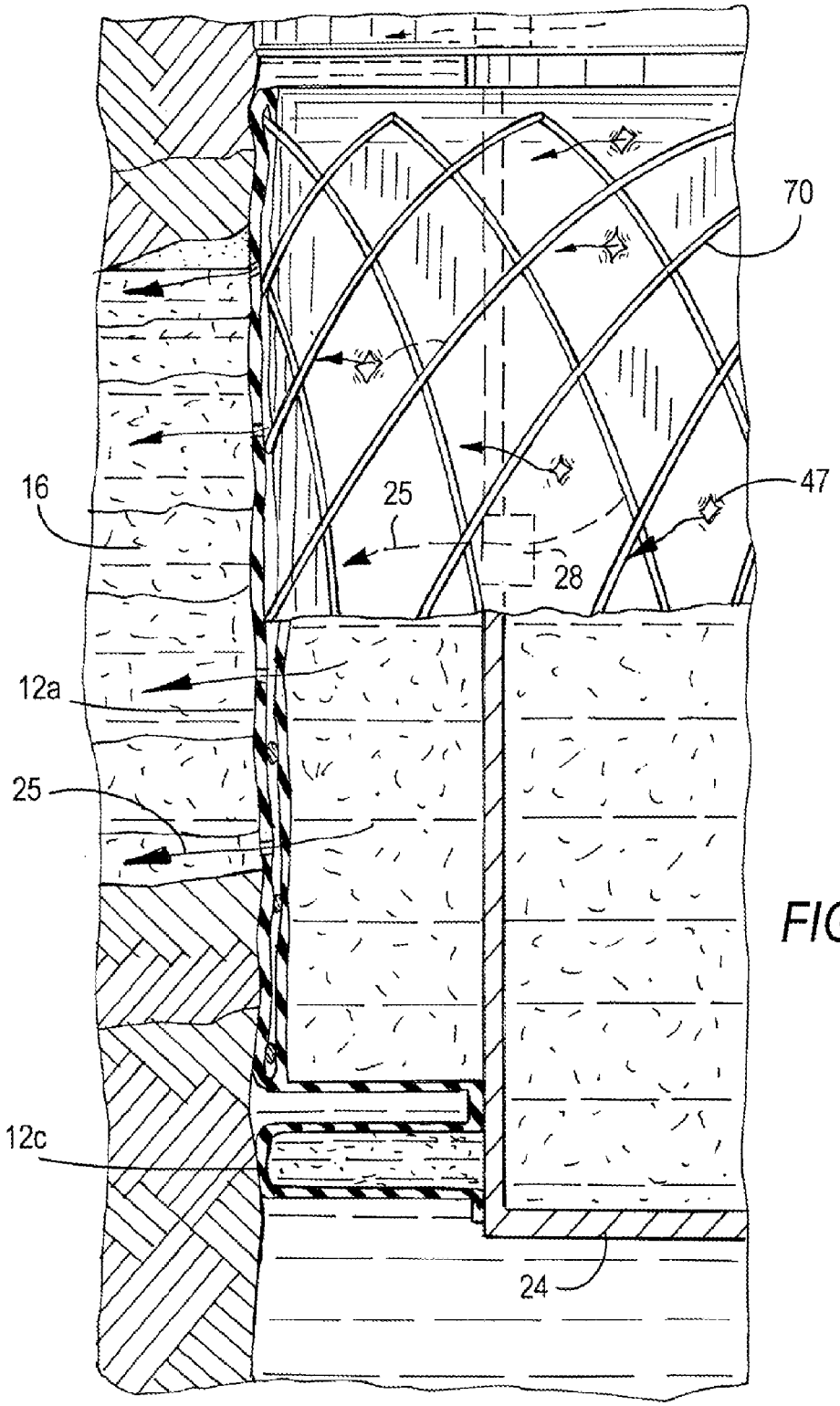
FIG. 19 is a view similar to FIG. 17 illustrating the full expansion of the central balloon and the expanded wire stent device against the formation wall.

Referring to FIGS. 17-19, in another embodiment of the invention an expandable wire stent device 70 is utilized to maintain the fully expanded central balloon against the wall of the wellbore. FIG. 17 illustrates the embodiment utilizing the expandable wire stent device 70, prior to initiation of the chemical reaction described above, where central balloon 12*a* and expandable stent device 70 have not yet been expanded by passage of formation plugging fluids from the inflating container 24 into the central balloon 12*a* through pressured-operated inflation valve 28.

As shown in the enlarged cross-sectional video of FIG. 18, the expandable wire stent 70 is positioned between two webs 72*a*, 72*b* and embedded in the walls of the central balloon 12*a*. Similarly to the embodiment illustrated in FIGS. 7-9, additional longitudinal support may be provided by rigid reinforcing bands or straps 42 which are also embedded in the walls of the central balloon 12*a*.

With reference to FIG. 19, upon initiation of the chemical reaction as discussed above with reference to FIG. 2B, the formation plugging fluid 25 is forced through pressure-operated inflation valves 26, 27, 28, thereby expanding the balloons 12*a*, 12*b*, 12*c*. As the central balloon 12*a* expands so does the extendable wire stent device 70 and the webs 72*a* and 72*b*. The webs 72*a* and 72*b* are fabricated from an extensible material that will stretch as the balloon and the wire stent expands. Polymers and copolymers of vinyl, polyethylene and polypropylene can be used. When the pressure in the central balloon 12*a* reaches a sufficient level, formation plugging fluids 25 pass through the ruptured weakened portions 47 of the central balloon, after which they penetrate the formation in the target zone 16. As in the embodiment described in FIG. 15, once the central balloon 12*a* and expandable stent device 70 are fully expanded against the wall surface, the heat of the reaction product softens and melts the central balloon 12*a* against the wall of the well, and is maintained in position by the expandable wire stent 70 and supported longitudinally by the rigid bands or straps 42 shown in FIG. 18.

Referring to FIGS. 20-23, in an alternative embodiment of the invention, the upper and lower balloons used to isolate target zone 16 are replaced by a dual inflatable packer system which includes an upper inflatable packer 80*a* and a lower inflatable packer 80*b*, each of which are inflated with wellbore fluid 31 by separate electric pumps 82*a* and 82*b*. The packers are constructed of a reinforced rubber composition for durability during repeated usage of the assembly. Electrical wiring (not shown) extends from each of the packers to the wellhead where controls for the pumps are provided. Inflatable packers are well known in the art and can be adapted by one of ordinary skill for use in this configuration of the present invention.

Figure 20:
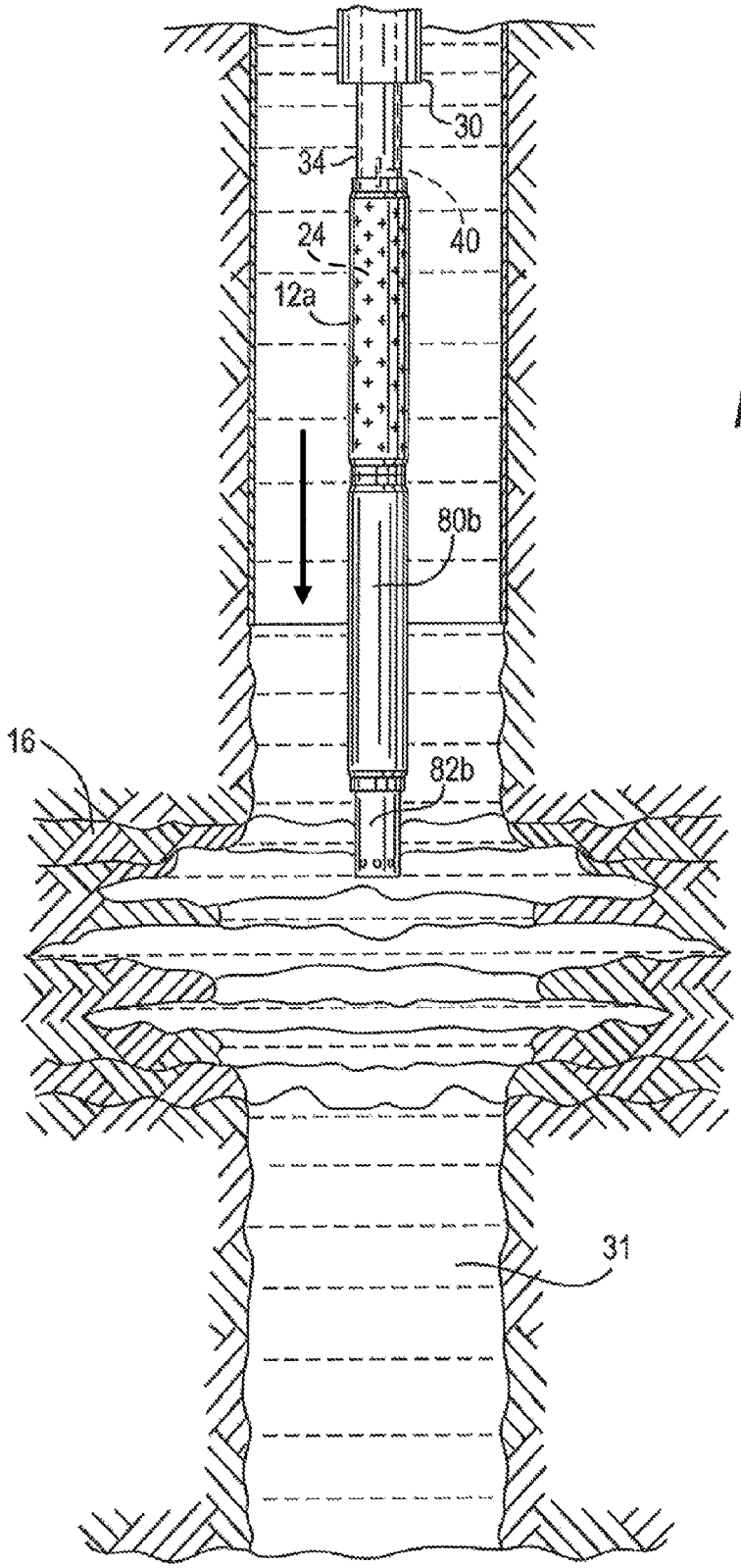
FIG. 20 is an elevation view, partly in cross-section, of another embodiment which includes dual inflatable packers in place of the upper and lower balloons, illustrating the lowering of the apparatus into position in the target zone.

FIG. 20 illustrates the lowering of the assembly utilizing the dual inflatable packer system through the production tubing 30 via the coiled tubing (not shown). The apparatus is lowered until the inflating container 24 and central balloon 12*a* are aligned with the target zone 16. As explained with respect to FIGS. 2A and 2B, the circulation valve 32 (not shown) is kept open while the tool is lowered into the borehole so that wellbore fluids enter the coiled tubing, thereby facilitating deployment of the assembly through the production tubing 30.

Figure 21:
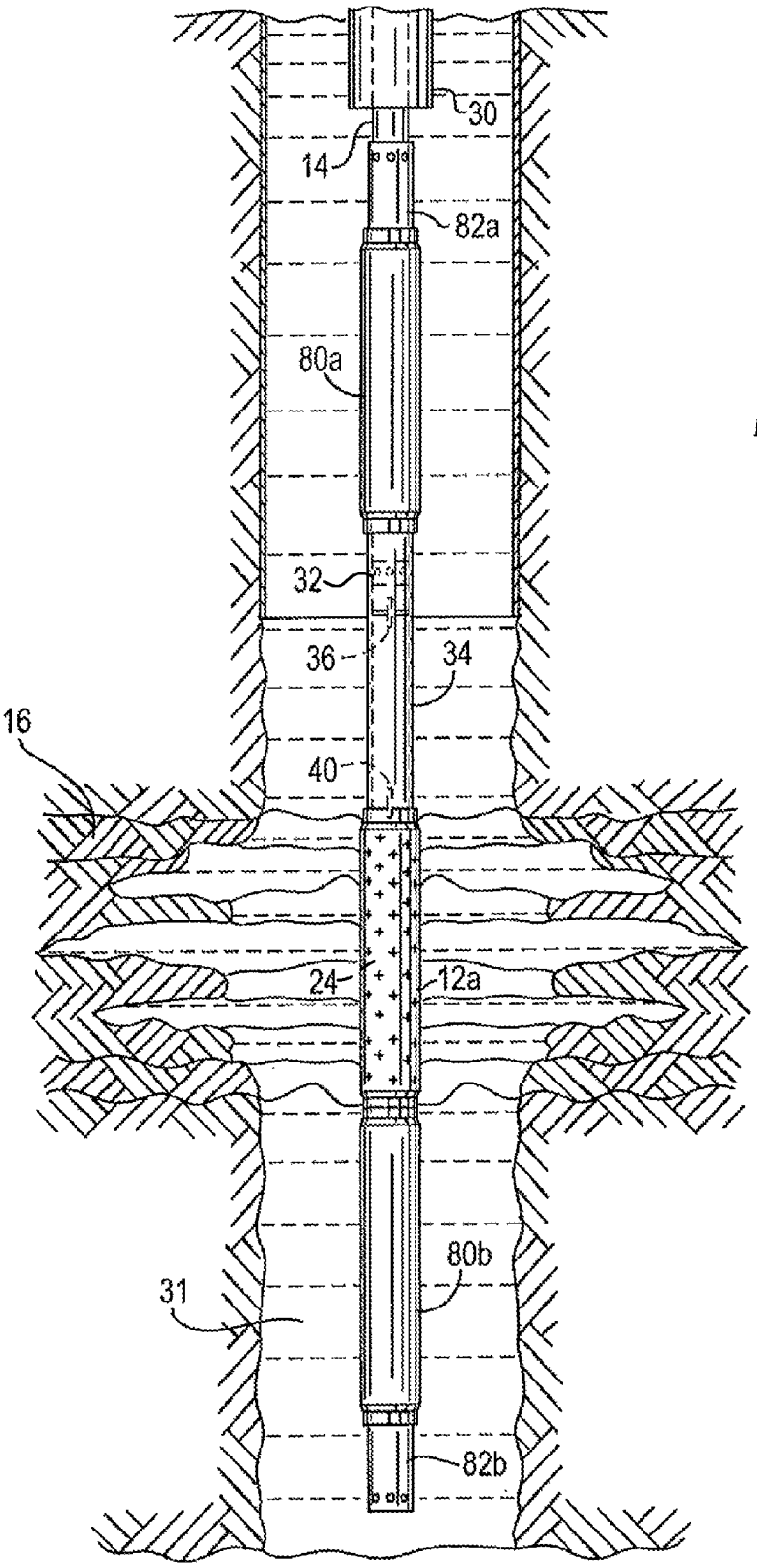
FIG. 21 is an elevation view, partly in cross-section, similar to FIG. 20, illustrating the apparatus in position so that the central balloon is aligned with the target zone.

With reference to FIG. 21, the upper inflatable packer 80*a* and its electric pump 82*a* are positioned above the circulation valve 32. The lower inflatable packer 80*b* and its associated electric pump 82*b* are positioned below the inflating container 24.

Figure 22:
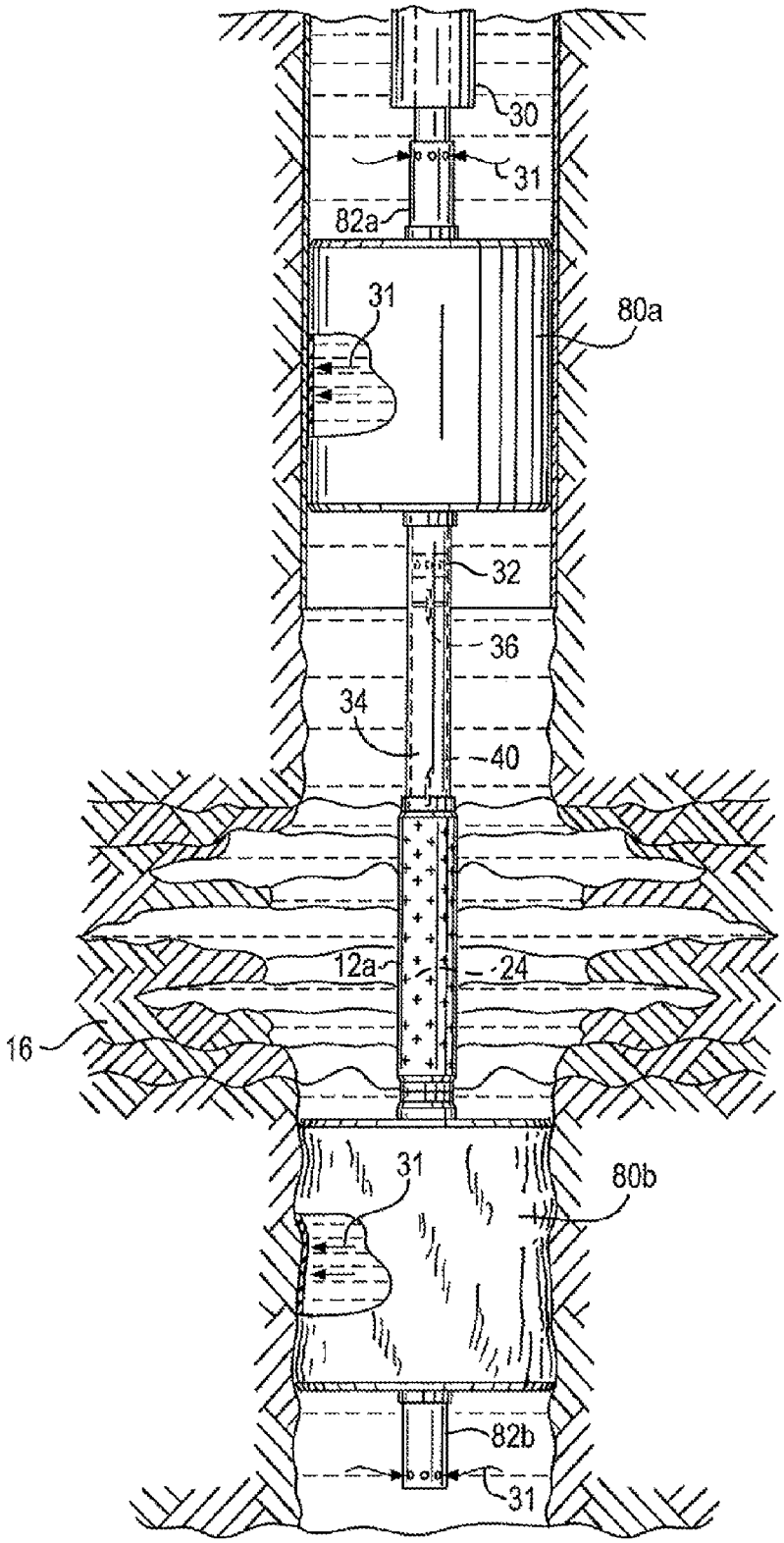
FIG. 22 is an elevation view, partly in cross-section, similar to FIG. 21, illustrating inflation of the upper and lower inflatable packers by their respective electric pumps.

FIG. 22 illustrates the inflation of the upper and lower inflatable packers 80*a* and 80*b* via electric pumps 82*a*, 82*b* which draw wellbore fluid 31 from the wellbore and discharge it under pressure into the inflatable packers 80*a*, 80*b*. When inflated, the upper and lower packers 80*a*, 80*b* expand into secure contact with the wellbore wall surface to maintain the assembly in a fixed position and to isolate the target zone 16 from wellbore fluids above and below the assembly.

Figure 23:
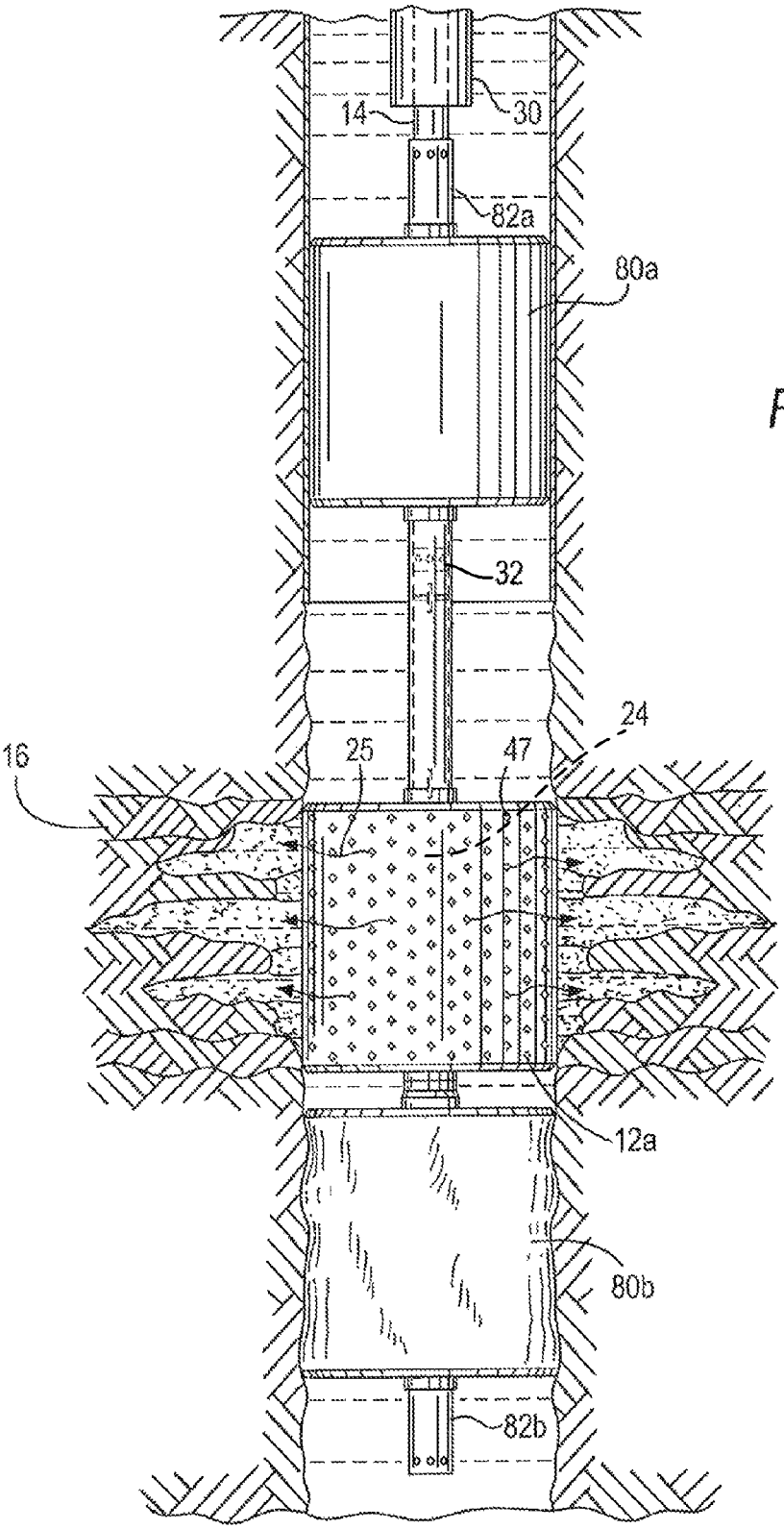
FIG. 23 is an elevation view, partly in cross-section, similar to FIG. 22, illustrating the passage of plugging fluid through the ruptured weakened portions of the inflated central balloon to penetrate the formation in the target zone.

With reference to FIG. 23, once the upper and lower inflatable packers 80*a*, 80*b* have been inflated, the inflation of the central balloon 12*a* is initiated in the same manner as described above with respect to FIG. 2B. The central balloon 12*a* is inflated by the reaction products (not shown) which force the formation plugging fluids 25 out of the inflating container and into the balloon so that the weakened sections 47 of the central balloon 12*a* rupture, allowing the formation plugging fluids 25 to flow through the ruptured weakened sections 47 and penetrate the formation in the target zone 16. The inflated central balloon 12*a* continues to expand and is softened and is melted by the heat of the reaction in the same manner that was described above with respect to FIG. 15 so that inflated central balloon 12*a*, which is in contact with the walls of the target zone 16, melts against the wall of the well, thereby sealing the target zone 16. In this embodiment, the central balloon 12*a* is supported against the wall of the well by one or more of the above-described structural elements such as the straps or bands of rigid high tensile material 42, the expandable ratchet ring 44, and the expandable metal stent 70. The remnants of the central balloon are separated along the circumferentially weakened lines.

After the target zone 16 has been sealed, the upper and lower inflatable packers 80*a*, 80*b* are deflated by the electric pumps 82*a*, 82*b*, which withdraw the wellbore fluid 31 from their respective packers and return it to the wellbore. Once the upper and lower packers 80*a*, 80*b* are sufficiently deflated, the apparatus is removed from the wellbore through the production tubing 30 via the coiled tubing 14.

The sequence of process steps can be summarized in conjunction with reference the drawings as follows:

FIG. 1 shows the apparatus in the initial state of its downhole deployment adjacent to the target zone 16 in the wellbore 11.

Figure 10:
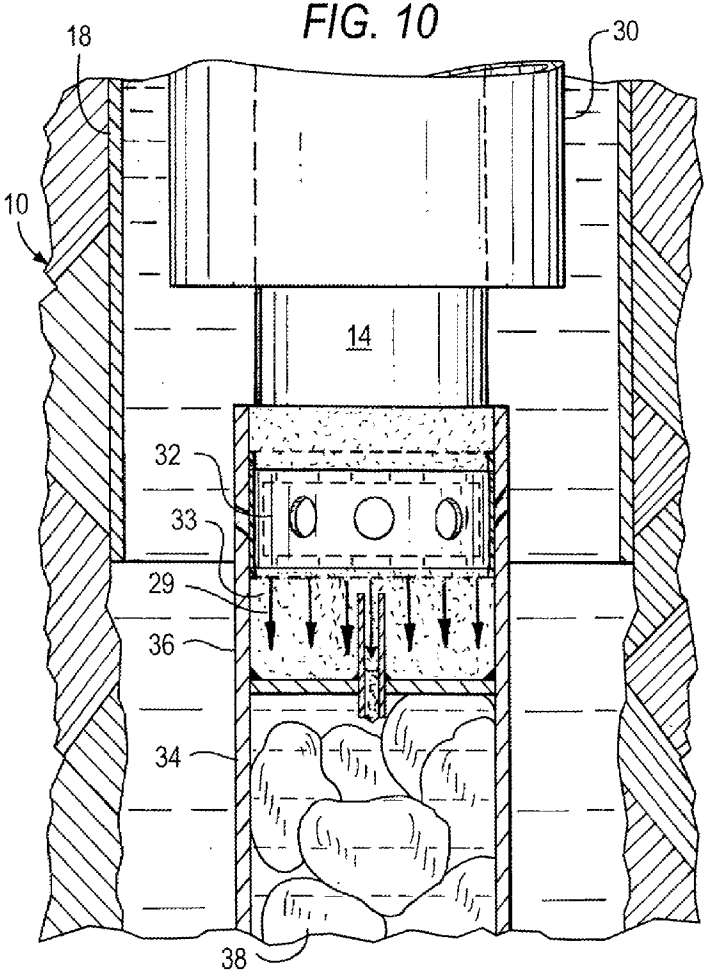
FIG. 10 is an enlarged elevation view of a timed circulation valve secured in fluid communication via a pressure-operated valve to the chemical container filled with a reactant material.

FIGS. 2A and 2B show the function of the timed circulation valve 32 which is kept open to facilitate deployment of the apparatus 10, while the tool is lowered into the borehole so that wellbore fluids 31 enter the coiled tubing 14. Once the balloon 12 reaches the target zone, the activating fluid reactant 33 pressurized by the displacing liquid (not shown) are pumped from the surface into the coiled tubing 14 to displace the wellbore fluids 31 through the timed circulation valve 32. Once the activating fluid reactant 33 reaches the circulation valve 32 depth and the wellbore fluids 31 have been displaced, the circulation valve 32 automatically closes. Additional displacing fluid is pumped into the coiled tubing 14 from the surface in order to increase the pressure to a sufficient level to open the pre-set pressure-operated upper inlet valve 36. As shown in FIG. 10, when valve 36 opens, the activating fluid reactant 33 enters the chemical container 34 to produce the reaction with the chemical(s) 38.

As shown in FIG. 11, the fluid reactant 33 enters the chemical container 34 via upper pressure-operated inlet valve 36 to initiate the reaction. The pressure of the reaction causes pressure-operated exit valve 40 to open, allowing the reaction products 29 to enter the inflating container tool 24.

Figure 12:
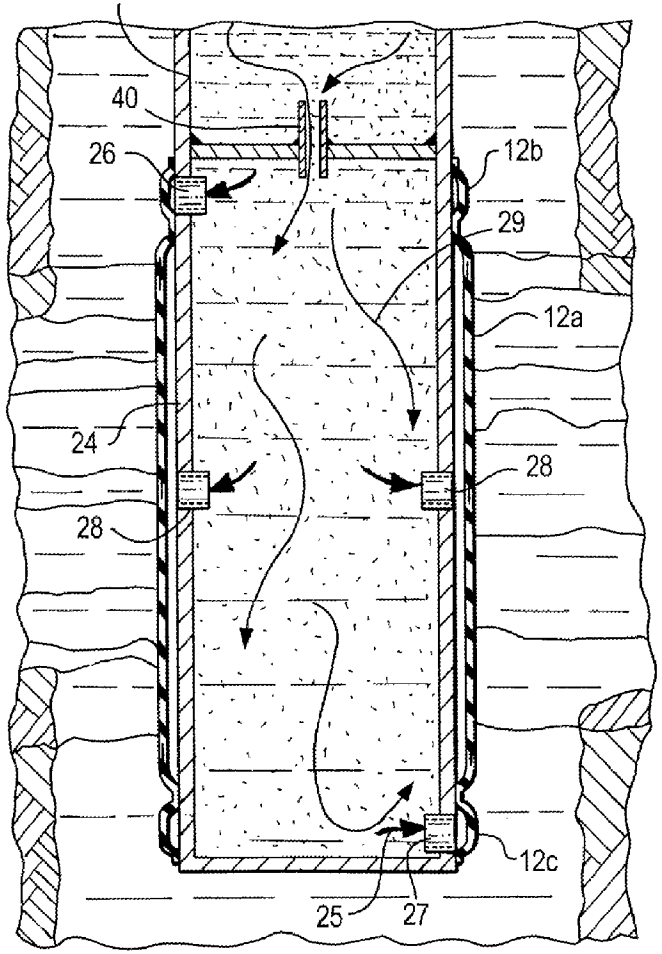
FIG. 12 is a cross-sectional view similar to FIG. 11 showing the lower pressure-operated valve advanced to the open position to permit entry of the reaction products from the chemical container to the inflating container to thereby displace the formation plugging material while separately inflating the three chemical balloons.

In FIG. 12, the hot reaction products 29 from the chemical container 34 enter the inflating container tool 24 through the lower pressure-operated valve 40 displacing the plugging fluid 25 into the balloons 12. The reaction products 29 pass through the pressure-operated inflation valves 26, 27 and 28 and the sequential full expansion of the balloon sections 12*b*, 12*c* and then 12*a* occurs as described in detail above in the discussion of FIGS. 13 and 14. Initially, upper balloon 12*b* and lower balloon 12*c* expand until they reach the wall surface and seal the adjoining annulus, while stabilizing the entire device during completion of the expansion of central balloon 12*a*, and its eventual melting and rupturing to secure the remnants to the wall of the wellbore.

FIG. 15 shows the path of the plugging fluid 25 and the reaction products 29 through the pressure-operated inflation valves 28. Specifically, the reaction products 29 force the plugging fluid 25 through the pressure-operated inflation valves 28 and then through the weakened sections of the balloon 47 (not shown). The reaction products 29 follow the same path through the pressure-operated inflation valves 28 and the weakened section of the balloon 47 (not shown).

FIG. 16 illustrates the removal of the apparatus from the wellbore 11 through production tube 30 after the wall has been plastered with, and sealed by the melted balloon 120*a* and end balloons 120*b*, 120*c* have been ruptured. It is noted that the remaining portions of the end balloon, 120*b* (not shown) and 120*c* which are attached to inflating container 24 are removed with the coiled tubing 14 (not shown).

The method and system of the present invention have been described above and in the attached drawings; however, modifications derived from this description will be apparent to those of ordinary skill in the art and the scope of protection for the invention is to be determined by the claims that follow.

What is claimed is:

1. An apparatus for sealing a section of a wall of a wellbore adjoining a target zone containing undesirable fluids for preventing penetration of the undesirable fluids into the wellbore, the apparatus comprising:

an inflatable balloon deployable in the wellbore, the balloon comprising a central section, and upper and lower sections located, respectively, on opposite ends of the central section, each section configured to inflate in response to receiving formation plugging fluid, wherein the central section comprises a plurality of weakened areas configured to rupture during inflation to discharge the formation plugging fluid;

a coiled tubing for deploying the inflatable balloon into the wellbore; and an inflating assembly tool for inflating the balloon to form a seal over the adjacent target zone of the well bore wall.

2. An apparatus for sealing a section of a wall of a wellbore adjoining a target zone containing undesirable fluids for preventing penetration of the undesirable fluids into the wellbore, the apparatus comprising:

an inflatable balloon deployable in the wellbore, the balloon comprising a central section, and upper and lower sections located, respectively, on opposite ends of the central section;

a coiled tubing for deploying the inflatable balloon into the wellbore; and an inflating assembly tool for inflating the balloon to form a seal over the adjacent target zone of the well bore wall, wherein the assembly tool comprises an inflating container filled with a formation plugging fluid and having at least three pressure-operated inflating valves for passing pressurized plugging fluid into the respective sections of the balloon.

3. An apparatus according to claim 2, wherein the central section of the balloon has a plurality of weakened areas configured to rupture during inflation to discharge plugging fluid.

4. An apparatus according to claim 2, wherein the downhole end of the coiled tubing is secured in fluid communication to a timed circulation valve, the timed circulation valve being programmed to be open for a predetermined time to circulate wellbore fluid into the coiled tubing while the balloon is lowered to a predetermined target zone, the timed circulation valve being set to close at a predetermined time required for pumping a fluid reactant via the coiled tubing from the surface to the circulation valve depth.

5. An apparatus according to claim 4, wherein an outlet of the circulation valve is in fluid communication with a chemical container containing a chemical reactant that produces an exothermic reaction upon addition of the fluid reactant, the chemical container in fluid communication with the timed circulation valve via a pressure-operated inlet valve programmed to open at a predetermined pressure to allow the fluid reactant to enter the chemical container, whereby a controlled explosive reaction occurs, the chemical container having a pressure-operated exit valve set to open under the pressure generated by the chemical reaction to admit reaction products into the inflating container, the inflating valves opening at a predetermined pressure in the inflating container to admit formation plugging fluid to inflate the sections of the balloon.

6. An apparatus according to claim 2, in which the inflating valves for the upper and lower sections are configured to provide a greater flow rate of the plugging fluid into the upper and lower balloon sections than the flow rate of plugging fluid into the central section, whereby the upper and lower sections are inflated more rapidly than the central section to provide fluid-tight seals against the wall of the well bore at opposite ends of the central section.

7. An apparatus according to claim 2, wherein upper and lower inflatable packers are secured and positioned above and below the inflatable balloon in axial alignment with the coiled tubing.

8. An apparatus according to claim 7, wherein each of the inflatable packers includes an electric pump in fluid communication with fluid in the wellbore.

9. An apparatus according to claim 7, wherein the inflatable assembly tool comprises an inflating container filled with a formation plugging fluid and at least one pressure-operated inflating valve for passing pressurized plugging fluid into the inflatable balloon.

10. An apparatus according to claim 9, wherein the balloon has a plurality of weakened areas configured to rupture during inflation to discharge plugging fluid.

11. An apparatus according to claim 9, which includes a timed circulation valve positioned below the upper inflatable packer in fluid communication with the coiled tubing, the timed circulation valve being programmed to be open for a predetermined time to circulate wellbore fluid into the coiled tubing while the balloon is lowered to a predetermined target zone, the timed circulation valve being set to close at a predetermined time required for pumping a fluid reactant via the coiled tubing from the surface to the circulation valve depth.

12. An apparatus according to claim 11, wherein an outlet of the circulation valve is in fluid communication with a chemical container containing a chemical reactant that produces an exothermic reaction upon addition of the fluid reactant, the chemical container in fluid communication with the timed circulation valve via a pressure-operated inlet valve programmed to open at a predetermined pressure to allow the fluid reactant to enter the chemical container, whereby a controlled explosive reaction occurs, the chemical container having a pressure-operated exit valve set to open under the pressure generated by the chemical reaction to admit reaction products into the inflating container, the inflating valve opening at a predetermine pressure in the inflating container to admit formation plugging fluid to inflate the balloon.

13. A method of sealing a section of a wall of a well bore adjoining a target zone containing undesirable fluids for preventing penetration of the undesirable fluids into the well bore, the method comprising the steps of:

deploying an inflatable balloon in the wellbore using a coiled tubing;

initiating an exothermic reaction to form reaction products;

flowing the reaction products into the balloon;

inflating, by the reaction products, the balloon to expand against and form a seal with the wall of the target zone; and contacting the reaction products with the interior of the inflated balloon to melt and separate the portion of the balloon in contact with the wall of the wellbore.

14. A method according to claim 13, wherein the inflatable balloon is deployed with a timed circulation valve which is programmed to keep the timed circulation valve open for a predetermined time necessary to circulate wellbore out of the well bore while the balloon is lowered to the predetermined target zone, introducing a fluid reactant into the coiled tubing and pumping said fluid reactant until it reaches the timed circulation valve, closing the timed circulation valve at the end of a predetermined time period required to pump the fluid reactant to the depth of the timed circulation valve, increasing pressure of the fluid reactant in the coiled tubing to a level sufficient to open a pressure-operated inlet valve that is located downstream of the timed circulation valve.

15. A method according to claim 14, comprising the steps of providing a chemical container containing a chemical reactant that produces an exothermic chemical reaction upon addition of a fluid reactant, introducing the fluid reactant into the chemical container to produce an exothermic controlled explosive reaction, and passing pressurized reaction products at a predetermined pressure into the inflating container, thereby displacing the formation plugging fluid and inflating the sections of the balloon.

16. A method according to claim 15, wherein the heat from the exothermic reaction softens and melts the portion of the central balloon that is in contact with the well bore wall and causes its separation from the remaining portions of the central balloon extending to their ends which remain secured to the inflating container.

17. A method according to claim 16 which includes increasing the internal pressure on the fluid in the inflating container from the surface via the coiled tubing to rupture the upper and lower balloons whereby the containers and the balloon remnants can be withdrawn through the production tubing.

18. A method according to claim 14, which includes positioning upper and lower inflatable packers above and below the balloon, inflating the inflatable packers with well bore fluids by activating electrical pumps associated with each of the packers, and forming fluid-tight seals with the wall of the well bore prior to inflating the balloon.

19. A method according to claim 18, wherein the step of inflating the balloon comprises providing an inflating container filled with a formation plugging fluid and having at least one inflating valve in fluid communication with the balloon and securely disposing the balloon around the inflating container for joint deployment of the balloon and inflating container.

20. A method according to claim 19, comprising the step of forming at least one weakened area in the balloon rupturing the at least one weakened area upon inflation of the balloon with formation plugging fluid, the upper and lower inflatable packers forming fluid-tight seals with the wall of the wellbore adjacent the balloon.

21. The method according to claim 20, wherein the formation plugging fluid passes through the rupture in the at least one weakened area of the balloon and is forced into the formation between the seals formed by the upper and lower inflatable packers as the balloon expands to the wall.

22. A method according to claim 19, comprising the steps of providing a chemical container containing a chemical reactant that produces an exothermic chemical reaction upon addition of a fluid reactant, introducing the fluid reactant into the chemical container to produce an exothermic controlled explosive reaction, and passing pressurized reaction products at a predetermined pressure into the inflating container, thereby displacing the formation plugging fluid and inflating the balloon.

23. A method according to claim 22, wherein the heat from the exothermic reaction softens and melts the portion of the balloon that is in contact with the well bore wall and causes its separation from the remaining portions of the balloon extending to their ends which remain secured to the inflating container.

24. A method according to claim 23, which includes deflating each of the expanded packers after the melted portion of the balloon has been separated from the inflating container by activating each of the electric pumps associated with the packers, and withdrawing the containers, deflated packers, and balloon remnants from the wellbore via the coiled tubing.

25. A method according to claim 13, wherein the balloon has a central section, and upper and lower sections located, respectively, on opposite ends of the central section and wherein the inflating step comprises providing an inflating container filled with a formation plugging fluid and having three inflating valves in fluid communication with the respective sections of the balloon for inflating them, and securely disposing the balloon around the inflating container for joint deployment of the balloon and inflating container.

26. A method according to claim 25, comprising the step of forming at least one weakened area in the central section, rupturing the at least one weakened upon inflation of the balloon with formation plugging fluid, the upper and lower sections forming fluid-tight seals with the wall of the well-bore adjacent the central section.

27. A method according to claim 25, wherein the inflating step comprises inflating the upper and lower sections more rapidly than the central section, whereby fluid-tight seals are provided against the wall of the well bore at the opposite ends of the central section.

28. A method according to claim 27, wherein the plugging fluid is forced into the formation between the seals formed by the upper and lower sections as the central balloon expands to the wall.

* * * * *